US012808069B2

(12) United States Patent
Zhanaidarova et al.

(10) Patent No.: US 12,808,069 B2
(45) Date of Patent: Nov. 24, 2026

(54) ELECTROCHEMICAL CONVERSION

(71) Applicants: The Regents of the University of California, Oakland, CA (US); California Institute of Technology, Pasadena, CA (US)

(72) Inventors: Almagul Zhanaidarova, La Jolla, CA (US); Clifford P. Kubiak, Del Mar, CA (US); Valerie Scott, Altadena, CA (US); Emmanuelle Despagnet-Ayoub, Pasadena, CA (US)

(73) Assignees: The Regents of the University of California; California Institute of Technolgoy

( * ) Notice: Subject to any disclaimer, the term of this patent is extended or adjusted under 35 U.S.C. 154(b) by 1449 days.

(21) Appl. No.: 17/599,030

(22) PCT Filed: Mar. 31, 2020

(86) PCT No.: PCT/US2020/026003

§ 371 (c)(1),
(2) Date: Sep. 28, 2021

(87) PCT Pub. No.: WO2021/002905

PCT Pub. Date: Jan. 7, 2021

(65) Prior Publication Data

US 2023/0083041 A1 Mar. 16, 2023

Related U.S. Application Data

(60) Provisional application No. 62/827,597, filed on Apr. 1, 2019.

(51) Int. Cl.

| | |
|---|---|
| ***B01J 31/18*** | (2006.01) |
| ***C25B 1/23*** | (2021.01) |
| ***C25B 11/054*** | (2021.01) |
| ***C25B 11/065*** | (2021.01) |
| ***C25B 11/085*** | (2021.01) |

(52) U.S. Cl.
CPC ..... *C25B 11/085* (2021.01); *C25B 1/23* (2021.01); *C25B 11/054* (2021.01); *C25B 11/065* (2021.01)

(58) Field of Classification Search
None
See application file for complete search history.

(56) References Cited

U.S. PATENT DOCUMENTS

| | | | |
|---|---|---|---|
| 4,711,708 | A | 12/1987 | Meyer et al. |
| 2009/0220835 | A1 | 9/2009 | Yushan et al. |
| 2018/0229227 | A1 | 8/2018 | Son et al. |
| 2019/0085473 | A1 | 3/2019 | Sugano et al. |

FOREIGN PATENT DOCUMENTS

| | | | |
|---|---|---|---|
| CN | 101432907 | A | 5/2009 |
| CN | 108262034 | A | 7/2018 |
| JP | A-S64-015388 | | 1/1989 |
| JP | A-2013-017929 | | 1/2013 |
| WO | WO 2005065100 | A2 | 7/2005 |
| WO | WO 2017123289 | | 7/2017 |

OTHER PUBLICATIONS

Smieja, Jonathan Mark, Electrocatalytic reduction of carbon dioxide to carbon monoxide by rhenium and manganese polypyridyl catalysts,(2012), UC San Diego. (Year: 2012).*
Smieja et al. "Kinetic and Structural studies, origins of selectivity, and interfacial charge transfer in the artificial photosynthesis of CO". PNAS, vol. 109, No. 39, 15646-156550. 2012. (Year: 2012).*
Oh et al. "Graphite-Conjugated Rhenium Catalysts for CO2 Reduction". J. Am. Chem. Soc. 138, 1820-1823. 2016. (Year: 2016).*
Smieja et al. "Re(Bipy-TBu)(CO)3Cl-improved Catalytic Activity for Reduction of CO2. .". Inorg. CHem. 49. 9283-9289. 2010. (Year: 2010).*
Extended European Search Report in European Appln. No. 20834709. 6, dated Sep. 1, 2023, 9 pages.
Nakada et al., "Selective electrocatalysis of a water-soluble rhenium (I) complex for CO2 reduction using water as an electron donor," ACS Catalysis, Jan. 5, 2018, 8(1):354-363.
Portenkirchner et al., "Using the alkynyl-substituted rhenium (I) complex (4, 4'-bisphenyl-ethynyl-2, 2'-bipyridyl) Re (Co) 3 Cl as catalyst for CO 2 reduction—synthesis, characterization, and application," Electrocatalysis, Mar. 2015, 6:185-197.
Zhang et al., "Heterogeneous molecular rhenium catalyst for CO2 photoreduction with high activity and tailored selectivity in an aqueous solution," Applied Catalysis B: Environmental, Dec. 15, 2019, 259: 9 pages.
Arai et al., "A Monolithic Device for CO2 Photoreduction to Generate Liquid Organic Substances in a Single-Compartment Reactor," Energy & Environment Science, May 2015, 8(7):1998-2002.
Azcarate et al., "Through-Space Charge Interaction Substituent Effects in Molecular Catalysis Leading to the Design of the Most Efficient Catalyst of CO2-to-CO Electrochemical Conversion," Journal of the American Chemical Society, Nov. 2016, 138(51):16639-16644.
Benson et al., "Electrocatalytic and Homogeneous Approaches to Conversion of CO2 to Liquid Fuels," Chemical Society Reviews, 2009, 38:89-99.
Blakemore et al., "Noncovalent Immobilization of Electrocatalysts on Carbon Electrodes for Fuel Production," Journal of the American Chemical Society, Nov. 2013, 135(49):18288-18291.

(Continued)

*Primary Examiner* — Sheng H Davis
(74) *Attorney, Agent, or Firm* — Fish & Richardson P.C.

(57) ABSTRACT

The present disclosure provides methods, compositions, devices, systems and uses that pertain to the electrochemical reduction of $CO_2$ to CO. The application presents a class of electrodes, incorporating molecular catalysts in nanostructures, for robust and efficient electrochemical systems, specifically, selective and robust hybrid electrodes, by incorporating a rhenium (Re) catalyst into the structure of highly porous heterogeneous materials. These electrodes can be scaled up to desired manufacturing dimensions due to their robust nature and methods or preparation.

19 Claims, 29 Drawing Sheets

(56) References Cited

OTHER PUBLICATIONS

Chen et al., "Aqueous CO2 Reduction at Very Low Overpotential on Oxide-Derived Au Nanoparticles," Journal of the American Chemical Society, Nov. 2012, 134(49):19969-19972.
Chen et al., "Selective Electrochemical CO2 Reduction Over Highly Porous Gold Films," Journal of Materials Chemistry A, Sep. 2017, 5(41):21955-21964.
Clark et al., "Kinetic and Mechanistic Effects of Bipyridine (bpy) Substituent, Labile Ligand, and Brønsted Acid on Electrocatalytic CO2 Reduction by Re(bpy) Complexes," ACS Catalysis, Jan. 2018, 8(3):2021-2029.
Clark et al., "Orientation of Cyano-Substituted Bipyridine Re(I) fac-Tricarbonyl Electrocatalysts Bound to Conducting Au Surfaces," The Journal of Physical Chemistry C, Jan. 2016, 120(3):1657-1665.
Denholm et al., "Overgeneration from Solar Energy in California: A Field Guide to the Duck Chart," Technical Report, National Renewable Energy Laboratory, Nov. 2015, 46 pages.
Donck et al., "Supramolecular assembly of cobaloxime on nanoring-coated carbon nanotubes: addressing the stability of the pyridine-cobalt linkage under hydrogen evolution turnover conditions," Chemical Communications, Sep. 2016, 52(79):11783-11786.
Francke et al., "Homogeneously Catalyzed Electroreduction of Carbon Dioxide-Methods, Mechanisms, and Catalysts," Chemical Reviews, Jan. 2018, 118(9):4631-4701.
Fukuda et al., "XPS, UPS, and TDS Study of Adsorption, Oxidation, and Hydrogenation of CO on Rhenium," Surface Science, Mar. 1980, 93(2-3):338-350.
Gentil et al., "Carbon-Nanotube-Supported Bio-Inspired Nickel Catalyst and Its Integration in Hybrid Hydrogen/Air Fuel Cells," Angewandte Chemie, International Edition, Feb. 2017, 56(7):1845-1849.
Gray, "Powering the planet with solar fuel," Nature Chemistry, Apr. 2009, 1:7.
Grice et al., "Recent Studies of Rhenium and Manganese Bipyridine Carbonyl Catalysts for the Electrochemical Reduction of CO2," Advances in Inorganic Chemistry, 2014, 66:163-188.
Hori et al., "Production of CO and CH4 in Electrochemical Reduction of CO2 at Metal Electrodes in Aqueous Hydrogencarbonate Solution," Chemistry Letters, 1985, 14(11):1695-1698.
International Preliminary Report on Patentability in International Appln. No. PCT/US2020/026003, dated Sep. 28, 2021, 7 pages.
International Search Report and Written Opinion in International Appln. No. PCT/US2020/026003, dated Feb. 26, 2021, 11 pages.
Jackson et al., "Strong Electronic Coupling of Molecular Sites to Graphitic Electrodes via Pyrazine Conjugation," Journal of the American Chemical Society, Jan. 2018, 140(3):1004-1010.
Keith et al., "Elucidation of the Selectivity of Proton-Dependent Electrocatalytic CO2 Reduction by fac-Re(bpy)(CO)3Cl," Journal of the American Chemical Society, Sep. 2013, 135(42):15823-15829.
Kramer et al., "Polymer coordination promotes selective CO2 reduction by cobalt phtalocyanine," Chemical Science, Apr. 2016, 7(4):2506-2515.
Kuhl et al., "New Insights into the Electrochemical Reduction of Carbon Dioxide on Metallic Copper Surfaces," Energy & Environment Science, Feb. 2012, (5):7050-7059.
Lewis et al., "Powering the planet: Chemical challenges in solar energy utilization," Proceedings of the National Academy of Sciences (PNAS), Oct. 2006, 103(43), 15729-15735.
Li et al., "CO2 Reduction at Low Overpotential on Cu Electrodes Resulting from the Reduction of Thick Cu2O Films," Journal of the American Chemical Society, Apr. 2012, 134(17):7231-7234.
Lin et al., "Covalent Organic Frameworks Comprising Cobalt Porphyrins for Catalytic CO2 Reduction in Water," Science, Sep. 2015, 349(6253):1208-1213.
Lu et al., "A Selective and Efficient Electrocatalyst for Carbon Dioxide Reduction," Nature Communications, Jan. 2014, 5(3242):1-6.
Ma et al., "Carbon Foam Decorated with Silver Nanoparticles for Electrochemical CO2 Conversion," Energy Technology, Jun. 2017, 5(6):861-863.
Min et al., "Pd-Catalyzed Electrohydrogenation of Carbon Dioxide to Formate: High Mass Activity at Low Overpotential and Identification of the Deactivation Pathway," Journal of the American Chemical Society, Mar. 2015, 137(14), 4701-4708.
Neri et al., "A Functionalised Nickel Cyclam Catalyst for CO2 Reduction: Electrocatalysis, Semiconductor Surface Immobilisation and Light-Driven Electron Transfer," Physical Chemistry Chemical Physics, 2015, 17:1562-1566.
O'Toole et al., "Electrocatalytic Reduction of CO2 by a Complex of Rhenium in Thin Polymeric Films," Journal of Electroanalytical Chemistry and Interfacial Electrochemistry, Feb. 1989, 259:217-239.
Oh et al., "Graphite-Conjugated Rhenium Catalysts for Carbon Dioxide Reduction," Journal of the American Chemical Society, Jan. 2016, 138(6):1820-1823.
Orchanian et al., "Surface-Immobilized Conjugated Polymers Incorporating Rhenium Bipyridine Motifs for Electrocatalytic and Photocatalytic CO2 Reduction," ACS Applied Energy Materials, 2019, 2(1):110-123.
Reuillard et al., "Tuning Product Selectivity for Aqueous CO2 Reduction with a Mn(bipyridine)-pyrene Catalyst Immobilized on a Carbon Nanotube Electrode," Journal of the American Chemical Society, Sep. 2017, 139(41):14425-14435.
Riplinger et al., "Influence of Weak Brønsted Acids on Electrocatalytic CO2 Reduction by Manganese and Rhenium Bipyridine Catalysts," ACS Catalysis, 2015, 5(2):900-908.
Sato et al., "Low-Energy Electrocatalytic CO2 Reduction in Water over Mn-Complex Catalyst Electrode Aided by a Nanocarbon Support and K+ Cations," ACS Catalysis, Apr. 2018, 8:4452-4458.
Sinha et al., "Heterogeneous Aqueous CO2 Reduction Using a Pyrene-Modified Rhenium(I) Diimine Complex," Inorganic Chemistry, Jul. 2019, 58(16):10454-10461.
Smieja et al., "Kinetic and Structural Studies, Origins of Selectivity and Interfacial Charge Transfer in the Artificial Photosynthesis of CO," Proceedings of the National Academy of Sciences (PNAS), May 2012, 109(39):15646-15650.
Smieja et al., "Manganese as a Substitute for Rhenium in CO2 Reduction Catalysts: The Importance of Acids," Inorganic Chemistry, Mar. 2013, 52(5):2484-2491.
Smieja et al., "Re(bipy-tBu)(CO)3Cl-Improved Catalytic Activity for Reduction of Carbon Dioxide: IR—Spectroelectrochemical and Mechanistic Studies," Inorganic Chemistry, Sep. 2010, 49(20):9283-9289.
Smieja, "Electrocatalytic reduction of carbon dioxide to carbon monoxide by rhenium and manganese polypyridyl catalysts," Dissertation for the degree of Doctor of Philosophy, University of California, San Diego, 2012, 235 pages.
Stor et al., "Spectroelectrochemical (IR, UV/Vis) Determination of the Reduction Pathways for a Series of [Re(CO)3(.alpha.-diimine)L']0/+ (L'=Halide, OTf-, THF, MeCN, n-PrCN, PPh3, P(OMe)3) Complexes," Organometallics, Mar. 1995, 14(3):1115-1131.
Sun et al., "Electrochemical CO2 Reduction at Glassy Carbon Electrodes Functionalized by MnI and ReI Organometallic Complexes," ChemPhysChem, Aug. 2017, 18(22):3219-3229.
Tasis et al., "Chemistry of Carbon Nanotubes," Chemical Reviews, Feb. 2006, 106(3):1105-1136.
Tran et al., "Noncovalent Modification of Carbon Nanotubes with Pyrene-Functionalized Nickel Complexes: Carbon Monoxide Tolerant Catalysts for Hydrogen Evolution and Uptake," Angewandte Chemie, International Edition, Jan. 2011, 50(6), 1371-1374.
Voyame, "Photocatalytic and Electrocatalytic Reduction of Carbon Dioxide in Pressurized Systems," Thesis for the degree of Doctor of Science, Ecole Polytechnique Federale de Lausanne, Apr. 2016, 193 pages.
Welch et al., "Nanoporous Gold as a Highly Selective and Active Carbon Dioxide Reduction Catalyst," ACS Applied Energy Materials, Jan. 2019, 2(1):164-170.
Wilhelm et al., "Low-Pressure Solubility of Gases in Liquid Water," Chemical Reviews, Apr. 1977, 77(2):219-262.

(56) References Cited

OTHER PUBLICATIONS

Zhanaidarova et al., "Covalent Attachment of [Ni(alkynyl-cyclam)]2+ Catalysts to Glassy Carbon Electrodes," Chemical Communications, Mar. 2018, 54(33):4116-4119.
Zhanaidarova et al., "Re(tBu-bpy)(CO)3Cl Supported on Multi-Walled Carbon Nanotubes Selectively Reduces CO2 in Water," Journal of the American Chemical Society, Oct. 2019, 141(43):17270-17277.
Zhanaidarova et al., "Selective Reduction of CO2 to CO by a Molecular Re(ethynyl-bpy)(CO)3Cl Catalyst and Attachment to Carbon Electrode Surfaces," Organometallics, Oct. 2018, 38(6):1204-1207.
Zhang et al., "Highly Selective and Active CO2 Reduction Electro-Catalysts Based on Cobalt Phthalocyanine/carbon Nanotube Hybrid Structures," Nature Communications, Mar. 2017, 8(14675):1-8.
Zhou et al., "Graphene-Immobilized fac-Re(bipy)(CO)3Cl for Syngas Generation from Carbon Dioxide," ACS Applied Materials & Interfaces Jan. 2016, 8(6), 4192-4198.
Kameta et al., "Enhancement of the photocatalytic activity of rhenium (I) complexes by encapsulation in light-harvesting soft nanotubes," Chemical Communications, 2017, 53(73):10116-10119.
Notice of Allowance in Japanese Appln. No. 2021-559049, mailed on Jan. 16, 2024, 6 pages (with English translation).
Office Action in Chinese Appln. No. 202080040769.X, mailed on Dec. 15, 2023, 28 pages (with English translation).

* cited by examiner

ELECTROCHEMICAL CONVERSION

CROSS-REFERENCE TO RELATED APPLICATION

This application is a National Stage Application under 35 U.S.C. § 371 and claims the benefit of International Application No. PCT/US2020/026003, filed Mar. 31, 2020, which claims priority to U.S. Ser. No. 62/827,597 entitled "ELECTROCHEMICAL CONVERSION" and filed on Apr. 1, 2019, which is incorporated by reference herein in its entirety

STATEMENT OF FEDERALLY SPONSORED RESEARCH

The invention described herein was made in the performance of work under a NASA contract NNN12AA01C, and is subject to the provisions of Public Law 96-517 (35 USC 202) in which the Contractor has elected to retain title.

This invention was made with government support under 80NMO0018D0004 awarded by National Aeronautics and Space Administration. The government has certain rights in the invention.

TECHNICAL FIELD

This invention relates to electrochemical conversion of $CO_2$ to CO and/or $O_2$, and more particularly to selective electrochemical conversion of $CO_2$ to CO and/or $O_2$ in water by a rhenium catalyst incorporated onto multi-walled carbon nanotubes (MWCNTs).

BACKGROUND

The availability of solar-generated electricity in some regions can exceed demand during daylight hours. Denholm P.; O'Connell M.; Brinkman G.; Jorgenson J., Overgeneration from Solar Energy in California: A Field Guide to the Duck Chart. *National Renewable Energy Laboratory* 2015. Advanced energy storage technologies are required to bank excess capacity for use during peak demand periods later in the day. One potential use of this excess renewable electricity is the electrochemical production of fuels and chemicals. The electrochemical reduction of $CO_2$ to CO with renewable electricity provides an environmentally friendly means of preparing synthesis gas and thereby a wide variety of chemicals and fuels via the Fisher-Tropsh process. Steynberg A. P., Introduction to Fischer-Tropsch Technology. *Studies in Surface Science and Catalysis* 2004, 152, 1-63. The development of robust and efficient systems for electrochemical $CO_2$ reduction to CO is a promising approach to the conversion of $CO_2$ to valuable products.

The properties of various metal electrodes for the electrochemical reduction of $CO_2$ was previously described, and led to the development of a variety of metallic electrodes for $CO_2$ reduction to CO, methane and even $C_2$-$C_3$ organic species. Hori Y. K.; Suzuki S., Production of CO and $CH_4$ in Electrochemical Reduction of $CO_2$ at Metal Electrodes in Aqueous Hydrogencarbonate Solution. *Chem. Lett.* 1985, 14, 1695-1698. Metal nanoparticle electrocatalysts composed of Ag and Au operate in aqueous solutions at low overpotentials. Ma S.; Liu J.; Sasaki K.; Lyth. S. M.; Kenis P. J. A., Carbon Foam Decorated with Silver Nanoparticles for Electrochemical $CO_2$ Conversion. *Energy Technol.* 2017, 5, 861-863; Welch A. J.; DuChene J. S.; Tagliabue G.; Davoyan A.; Cheng W. H.; Atwater H. A., Nanoporous Gold as a Highly Selective and Active Carbon Dioxide Reduction Catalyst. *ACS Appl. Energy Mater.* 2019, 2 (1), 164-170. The recent development of nanostructured copper based electrodes led to the production of $C_1$-$C_3$ organic species depending on the conditions and active sites of metallic copper. Li C. W.; Kanan M. W., $CO_2$ Reduction at Low Overpotential on Cu Electrodes Resulting from the Reduction of Thick $Cu_2O$ Films. *J. Am. Chem. Soc.* 2012, 134 (17), 7231-7234; Kuhl K. P.; Cave E. R.; Abram D. N.; Jaramillo T. F., New Insights into the Electrochemical Reduction of Carbon Dioxide on Metallic Copper Surfaces. *Energy Environ. Sci.* 2012, 5, 7050-7059. However, these nanostructured electrodes are complicated to prepare, and often require additional etching steps and expensive equipment. Moreover, during operation, they can suffer from oxidation and surface reconstruction that decrease selectivity and longevity. Accordingly, there is a need for simple, highly selective, and robust catalysts and catalytic systems for electrochemical reduction.

SUMMARY

The present application relates to methods of making, compositions, systems, and uses of selective and robust hybrid electrodes that comprise a catalyst (e.g., a rhenium catalyst) that is incorporated into the structure of a highly porous heterogeneous material (e.g., multi-walled carbon nanotubes (MWCNTs)). The incorporation of molecular catalysts into the structure of carbon nanotubes retains the desirable properties of molecular catalysts, such as selectivity, while achieving a higher turnover rate than when the catalyst is used homogenously. For example, MWCNTs are a suitable electrode material for catalyst incorporation due to their high surface area matrix and high electrical conductivity. These electrodes can, for example, perform selective electrochemical reduction of $CO_2$ to CO in water.

As one example, supporting Re(tBu-bpy)$(CO)_3$Cl on MWCNTs can significantly lower catalyst loadings, increase current densities, decrease overpotential, retain high selectivity for reduction of $CO_2$ to CO, and allow operation in water at, e.g., pH=7.3 compared to when the catalyst is used homogeneously in solution. Re/MWCNT electrocatalysts can achieve current densities of ~4 mA/$cm^2$ and selectivities (FEco) of about 99% at −0.59 V vs. reversible hydrogen electrode (RHE) in $CO_2$ saturated aqueous $KHCO_3$ solutions. Further, the Re/MWCNT electrocatalysts achieve turnover number (TON)>5600 and turnover frequency (TOF)>1.6 $s^{-1}$. The electrodes can also be scaled up to desired manufacturing dimensions due to their robustness and efficient method of preparation. Further, the electrodes are a practical means of meeting demand for CO in, for example, the production of fuels and chemicals (e.g., the production of fuels and chemicals via the Fischer-Tropsch process). The electrodes can also be used in the $CO_2$-rich atmosphere of Mars to produce CO.

In one aspect, provided herein is a composition comprising a rhenium catalyst and a carbon support;

wherein:

the rhenium catalyst has the formula Re(4,4'-R-2,2'-bipyridine)$(CO)_3$X;

R is an electron donating group or an electron withdrawing group;

X is a halogen, acetonitrile, $CH_3CN$(OTf), or Py(OTf); and wherein the rhenium catalyst is dispersed on the surface of the carbon support.

In some embodiments, the carbon support is multi-walled carbon nanotubes.

In some embodiments, X is a halogen.

For example, X is chloro.

In some embodiments, R is an electron donating group.

In some embodiments, the rhenium catalyst is Re(tBu-bpy)$(CO)_3$Cl.

In some embodiments, R is an electron withdrawing group.

In some embodiments, the composition is characterized by a current density of at least about 4 mA/$cm^2$.

In some embodiments, the composition is characterized by a current density of about 4 mA/$cm^2$.

In some embodiments, the composition is characterized by a TON greater than about 5600 and a TOF greater than about 1.6 $s^{-1}$.

In another aspect, provided herein is a method for electrocatalytically reducing $CO_2$ to CO, comprising:

contacting an electrode with $CO_2$;

wherein the electrode is in an aqueous solution having a pH of at least 4, comprising an electrolyte;

wherein the electrode comprises a carbon support and a rhenium catalyst having the formula Re(4,4'-R-2,2'-bipyridine)$(CO)_3$X;

R is an electron donating group or an electron withdrawing group;

X is a halogen, acetonitrile, $CH_3CN$(OTf), or Py(OTf);

wherein the rhenium catalyst is dispersed on the surface of the carbon support; and wherein the method is performed at a temperature of at least about 5 °C.

In some embodiments, the carbon support is multi-walled carbon nanotubes.

In some embodiments, X is a halogen. For example, X is chloro.

In some embodiments, R is an electron donating group.

In some embodiments, R is an electron withdrawing group.

In some embodiments, the rhenium catalyst is Re(tBu-bpy)$(CO)_3$Cl.

In some embodiments, R is an electron withdrawing group.

In some embodiments, the selectivity for CO over $H_2$ is at least about 99%.

In some embodiments, the selectivity for CO over $H_2$ is from about 30% to about 100%.

In some embodiments, the Faradaic efficiency is at least about 99%.

In some embodiments, the electrolyte comprises $KHCO_3$.

In some embodiments, the method is performed at a temperature of from about 5 °C to about 35 °C.

In some embodiments, the method is performed at a temperature of from about 15 °C to about 25 °C.

In some embodiments, the pH of the aqueous solution is from about 6 to about 8.

In some embodiments, the pH of the aqueous solution is from about 6.5 to about 7.5.

In some embodiments, the pH of the aqueous solution is about 7.3.

In some embodiments, the method is characterized by a current density of at least about 4 mA/$cm^2$.

In some embodiments, the method is characterized by a current density of about 4 mA/$cm^2$.

In some embodiments, the method is characterized by a TON greater than about 5600 and a TOF greater than about 1.6 $s^{-1}$.

In another aspect, provided herein is a process for preparing an electrode, comprising:

suspending a rhenium catalyst, a carbon support, and carbon nanofiber in ethanol;

sonicating the suspension;

drop-casting the suspension onto a glassy carbon plate;

drying the drop-casted glassy carbon plate at a temperature from about 100 °C to about 180 °C for about 0.5 to about 24 hours; and wherein the rhenium catalyst has the formula Re(4,4'-R-2,2'-bipyridine)$(CO)_3$X;

R is an electron donating group or an electron withdrawing group; and

X is a halogen, acetonitrile, $CH_3CN$(OTf), or Py(OTf).

In some embodiments, X is a halogen. For example, X is chloro.

In some embodiments, R is an electron donating group.

In some embodiments, the rhenium catalyst is Re(tBu-bpy)$(CO)_3$Cl.

In some embodiments, R is an electron donating group.

In some embodiments, the electrode is characterized by a current density of at least about 4 mA/$cm^2$.

In some embodiments, the electrode is characterized by a current density of about 4 mA/$cm^2$.

In some embodiments, the electrode is characterized by a TON greater than about 5600 and a TOF greater than about 1.6 $s^{-1}$.

In some embodiments, the suspension is drop-casted at a temperature from about 40 °C to about 80 °C.

In some embodiments, the suspension is drop-casted at a temperature of about 60 °C.

In some embodiments, the drop-casted glassy carbon plate is dried at a temperature of about 150 °C for about 1 hour.

In some embodiments, the carbon support is multi-walled carbon nanotubes.

In some embodiments, the method of fabrication is eco-friendly and does not require the use of hazardous organic solvents (e.g., dimethyl formamide (DMF), dichloromethane, and acetonitrile). Further, it can avoid burdensome preparation steps, such as acid etching and metal deposition.

DEFINITIONS

As used herein, the terms "about" and "approximately" are used interchangeably, and when used to refer to modify a numerical value, encompass a range of uncertainty of the numerical value of from 0% to 10% of the numerical value.

As used herein, the singular forms "a," "an," and "the" include plural referents unless the context clearly dictates otherwise.

The details of one or more embodiments of the invention are set forth in the accompanying drawings and the description below. Other features, objects, and advantages of the invention will be apparent from the description and drawings, and from the claims.

DESCRIPTION OF DRAWINGS

experiments.

DETAILED DESCRIPTION

Figure 1:
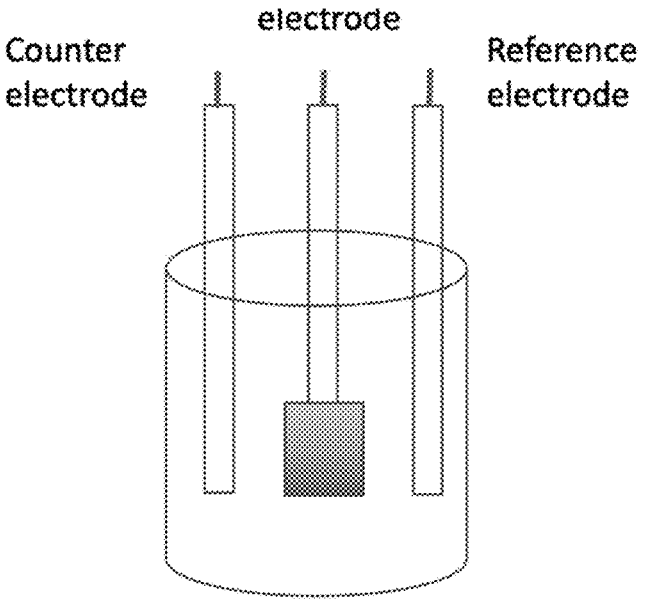
FIG. 1 is a schematic of a three-electrode cell configuration.

The present application provides a rhenium catalyst dispersed on multi-walled carbon nanotubes (MWCNTs) that can be used as an electrocatalyst for converting $CO_2$ to CO. The rhenium catalyst can be, for example, Re(4,4'-tBu-2,2'-bpy)$(CO)_3$Cl. FIG. 1 is a schematic of a three-electrode cell configuration that the electrocatalyst can be used in. When used as an electrocatalyst, Re(tBu-bpy)/MWCNT electrodes can exhibit one or more of a Faradaic efficiency for CO FECO=99% and less than 1% $H_2$, low operating potential (−0.58 V vs. RHE), the ability to sustain constant CO production for more than 7 h, and can work in water with a supporting electrolye (e.g., 0.5 M $KHCO_3$).

The electrodes provided herein (e.g., Re(tBu-bpy)/MWCNT) can display excellent activity and selectivity in the electrochemical reduction of $CO_2$ to CO. These electrodes operated at −0.58 V vs. RHE in 0.5 M $KHCO_3$ with 99% selectivity for CO and only trace quantities of $H_2$.

Some embodiments provide a composition comprising a rhenium catalyst and multi-walled carbon nanotubes; wherein: the rhenium catalyst has the formula Re(4,4'-R-2,2'-bipyridine)$(CO)_3$X; R is an electron donating group or an electron withdrawing group; X is a halogen, acetonitrile, $CH_3CN$(OTf), or Py(OTf); and wherein the rhenium catalyst is dispersed on the surface of the multi-walled carbon nanotubes.

In some embodiments, the diameter of the nanotubes is about 5 nm to about 25 nm. For example, the diameter of the nanotubes is about 5 nm to about 10 nm, about 10 nm to about 15 nm, about 15 nm to about 20 nm, about 20 nm to about 25 nm, about 10 nm to about 20 nm, about 12 nm to about 18 nm, or about 15 nm.

In some embodiments, the loading of the transition metal catalyst (e.g., the rhenium catalyst), is from about 0.2 wt % to about 50 wt %. For example, from about 0.4 wt % to about 25 wt %, from about 2.5 wt % to about 30 wt %, from about 5 wt % to about 25 wt %, from about 10 wt % to about 23 wt %, from about 14 wt % to about 20 wt %, about 0.42 wt %, about 2.5 wt %, about 13.9 wt %, about 23.1 wt %, or about 25.2 wt %.

In some embodiments, X is a halogen, such as fluorine, chlorine, bromine, or iodine. In some embodiments, X is X is chloro.

In some embodiments, R is an electron donating group. In some embodiments, R is a $C_1$-$C_{10}$ alkyl group, for example, an isopropyl, t-butyl, or neopentyl group. In other embodiments, R is an electron withdrawing group. For example, R is F, Cl, $CF_3$, —C(O)$C_1$-$C_4$ alkyl (e.g., acetyl), or —C(O)$OC_1$-$C_4$ alkyl (e.g., —C(O)OMe or —C(O)OEt).

In some embodiments, the rhenium catalyst is Re(tBu-bpy)$(CO)_3$Cl.

In some embodiments, the concentration of rhenium on the surface of the carbon support as measured by survey X-ray photoelectron spectroscopy is about 0.6 wt % to about 1.4 wt %. For example, about 0.8 wt % to about 1.2 wt %, about 0.9 wt % to about 1.1 wt %, about 1 wt %, or about 0.98 wt %.

In some embodiments, the concentration of nitrogen on the surface of the carbon support as measured by survey X-ray photoelectron spectroscopy is about 0.5 wt % to about 3.5 wt %. For example, about 1 wt % to about 3 wt %, about 1.5 wt % to about 2.5 wt %, about 1.7 wt % to about 2.3 wt %, about 2 wt %, or about 1.93 wt %.

In some embodiments, the concentration of chlorine on the surface of the carbon support as measured by survey X-ray photoelectron spectroscopy is about 0.6 wt % to about 1.4 wt %. For example, about 0.8 wt % to about 1.2 wt %, about 0.9 wt % to about 1.1 wt %, about 1 wt %, or about 0.98 wt %.

In some embodiments, the composition is characterized by a current density of at least about 0.1 $mA/cm^2$. In some embodiments, the composition is characterized by a current density of at least about 1 $mA/cm^2$. In some embodiments, the composition is characterized by a current density of from about 1 $mA/cm^2$ to about 4 $mA/cm^2$, from about 4 $mA/cm^2$ to about 10 $mA/cm^2$, from about 4 $mA/cm^2$ to about 6 $mA/cm^2$, from about 6 $mA/cm^2$ to about 8 $mA/cm^2$, or from about 8 $mA/cm^2$ to about 10 $mA/cm^2$, about 1 $mA/cm^2$, about 1.3 $mA/cm^2$, about 3.1 $mA/cm^2$, or about 4 $mA/cm^2$.

In some embodiments, the composition is characterized by a current density of at least about 4 $mA/cm^2$. In some embodiments, the composition is characterized by a current density of about 4 $mA/cm^2$, about 5 $mA/cm^2$, about 6 $mA/cm^2$, about 7 $mA/cm^2$, about 8 $mA/cm^2$, about 9 $mA/cm^2$, or about 10 $mA/cm^2$. For example, composition is characterized by a current density of about 4 $mA/cm^2$.

In some embodiments, the composition is characterized by a TON greater than about 4000. For example, the composition is characterized by a TON greater than about 4500, greater than about 4800, greater than about 5000, greater than about 5200, greater than about 5400, greater than about 5500, greater than about 5600, greater than about 5650, greater than about 5700, or about 5620, For example, the composition is characterized by a TON greater than about 5600.

In some embodiments, the composition is characterized by a TOF greater than about 1.0 $s^{-1}$. For example, the composition is characterized by a TOF greater than about 1.0 $s^{-1}$, greater than about 1.1 $s^{-1}$, greater than about 1.3 $s^{-1}$, greater than about 1.6 $s^{-1}$, greater than about 2.0 $s^{-1}$, greater than about 3.0 $s^{-1}$, greater than about 4.0 $s^{-1}$, greater than about 5.0 $s^{-1}$, greater than about 10.0 $s^{-1}$, greater than about 1 $m^{-1}$, greater than about 10 $m^{-1}$, greater than about 1 $h^{-1}$, greater than about 6 $h^{-1}$, greater than about 12 $h^{-1}$, greater than about 50 $h^{-1}$, greater than about 100 $h^{-1}$, greater than about 200 $h^{-1}$, greater than about 300 $h^{-1}$, about 297 $h^{-1}$, about 12 $h^{-1}$, or about 1.6 $s^{-1}$. For example, the composition is characterized by a TOF greater than about 1.6 $s^{-1}$.

In some embodiments, the composition is characterized by a TON greater than about 5600 and a TOF greater than about 1.6 $s^{-1}$.

Some embodiments provide a method for electrocatalytically reducing $CO_2$ to CO, comprising: contacting an electrode as provided herein with $CO_2$; wherein the electrode is in an aqueous solution having a pH of at least about 4; and wherein the method is performed at a temperature of at least about 5 °C.

Some embodiments provide a method for electrocatalytically reducing $CO_2$ to CO, comprising: contacting an electrode with $CO_2$; wherein the electrode is in an aqueous solution having a pH from about 6 to about 8, comprising an electrolyte; wherein the electrode comprises multi-walled carbon nanotubes and the rhenium catalyst has the formula Re(4,4'-R-2,2'-bipyridine)$(CO)_3X$; R is an electron donating group or an electron withdrawing group; X is a halogen, acetonitrile, $CH_3CN(OTf)$, or Py(OTf); wherein the rhenium catalyst is dispersed on the surface of the multi-walled carbon nanotubes; and wherein the method is performed at a temperature of from about 5 °C to about 35 °C.

In some embodiments, the selectivity for CO over $H_2$ is from about 30% to about 100%. In some embodiments, the selectivity for CO over $H_2$ is at least about 99%. In some embodiments, the Faradaic efficiency is at least about 99%. For example, the Faradaic efficiency is 100%.

In some embodiments, the electrolyte comprises $KHCO_3$, HCl, NaOH, $K_2SO_4$ CHCOOH, $H_2CO_3$, $NH_4OH$, and $H_2S$. For example, the electrolyte comprises $KHCO_3$.

In some embodiments, the concentration of the electrolyte is from about 0.01M to about 0.5M. For example, the concentration of the electrolyte is from about 0.05M to about 0.2M, 0.08M to about 0.13M, or about 0.1M.

For example, in some embodiments, the method is performed at a temperature of about 5 °C to about 30 °C, about 5 °C to about 20 °C, about 10 °C to about 25 °C, about 15 °C to about 30 °C, about 20 °C to about 35 °C, or any value in between. In some embodiments, the method is performed at a temperature of from about 15 °C to about 25 °C.

In some embodiments, the pH of the aqueous solution is from about 4 to about 10. In certain embodiments, the pH of the aqueous solution is from about 4 to about 6, from about 5.5 to about 9, from about 6 to about 8, from about 7.3 to about 10, or from about 6.5 to about 7.5. For example, the pH of the aqueous solution is about 7.3.

In some embodiments, the applied potential is from about −0.3 V to about −0.8 V. For example, the applied potential is from about −0.4 V to about −0.7 V, from about −0.5 V to about −0.6 V, or about −0.56 V.

In some embodiments, the method is performed in a low gravity environment (e.g., an environment where the force of gravity is less than that found on Earth). For example, the method is performed in Earth's thermosphere, Earth's exosphere, interplanetary space, on Earth's moon, or Mars. For example, the method is performed on Mars.

In some embodiments, the method further comprises producing $O_2$ from the $CO_2$.

Some embodiments provide a process for preparing an electrode, comprising: suspending a rhenium catalyst, a carbon support (e.g., multi-walled carbon nanotubes), and carbon nanofiber in ethanol; sonicating the suspension; drop-casting the suspension onto a glassy carbon plate; drying the drop-casted glassy carbon plate at a temperature from about 100 °C to about 180 °C for about 0.5 to about 24 hours; and wherein the rhenium catalyst has the formula Re(4,4'-R-2,2'-bipyridine)$(CO)_3X$; R is an electron donating group or an electron withdrawing group; and X is a halogen, acetonitrile, $CH_3CN(OTf)$, or Py(OTf).

Some embodiments provide a process for preparing an electrode, comprising: suspending a transition metal catalyst, multi-walled carbon nanotubes, and carbon nanofiber in ethanol; sonicating the suspension; drop-casting the suspension onto a glassy carbon plate at a temperature from about 40 °C to about 80 °C; drying the drop-casted glassy carbon plate at a temperature from about 100 °C to about 180 °C for about 0.5 to about 24 hours; and wherein the transition metal catalyst has the formula M(4,4'-R-2,2'-bipyridine)$(CO)_3X$; R is an electron donating group or an electron withdrawing group; M is a transition metal; and X is a halogen, acetonitrile, $CH_3CN(OTf)$, or Py(OTf).

In some embodiments, X is a halogen, such as fluorine, chlorine, bromine, or iodine. In some embodiments, X is X is chloro.

In some embodiments, R is an electron donating group. In some embodiments, R is a C1-C10 alkyl group, for example, an isopropyl, t-butyl, or neopentyl group. In other embodiments, R is an electron withdrawing group. For example, R is F, Cl, $CF_3$, —C(O)$C_1$-$C_4$ alkyl (e.g., acetyl), or —C(O)$OC_1$-$C_4$ alkyl (e.g., —C(O)OMe or —C(O)OEt).

In some embodiments, the transition metal is a Group III transition metal. In other embodiments, the transition metal is a Group IV transition metal. In still other embodiments, the transition metal is a Group V transition metal. In some embodiments, the transition metal is a Group VI transition metal. In other embodiments, the transition metal is a Group VII transition metal. In still other embodiments, the transition metal is a Group VIII transition metal. In some embodiments, the transition metal is a Group IX transition metal. In other embodiments, the transition metal is a Group X transition metal. In still other embodiments, the transition metal is a Group XI transition metal. In some embodiments, the transition metal is a Group XII transition metal.

In some embodiments, the transition metal is a Period 4 transition metal. In other embodiments, the transition metal is a Period 5 transition metal. In still other embodiments, the transition metal is a Period 6 transition metal.

In some embodiments, the transition metal is selected from iron, nickel, copper, palladium, and platinum.

Some embodiments provide a process for preparing an electrode, comprising: suspending a rhenium catalyst, multi-walled carbon nanotubes, and carbon nanofiber in ethanol; sonicating the suspension; drop-casting the suspension onto a glassy carbon plate at a temperature from about 40 °C to about 80 °C; drying the drop-casted glassy carbon plate at a temperature from about 100 °C to about 180 °C for about 0.5 to about 24 hours; and wherein the rhenium catalyst has the formula Re(4,4'-R-2,2'-bipyridine)$(CO)_3$X; R is an electron donating group or an electron withdrawing group; and X is a halogen, acetonitrile, $CH_3CN$(Otf), or Py(OTf).

In some embodiments, after sonicating the suspension, water is added. In some of these embodiments, after adding water, the suspension is sonicated further.

In some embodiments, the suspension is drop-casted at a temperature from about 30 °C to about 120 °C. For example, the suspension is drop-casted at a temperature from about 30 °C to about 60 °C, from about 40 °C to about 80 °C, from about 60 °C to about 120 °C, from about 50 °C to about 70 °C, from about 55 °C to about 65 °C, or from about 57 °C to about 63 °C. In some embodiments, the suspension is drop-casted at a temperature of about 60 °C.

In some embodiments, the suspension is drop-casted glassy carbon plate is dried at a temperature of about 150 °C for about 1 hour.

In some embodiments, the process is performed in a low gravity environment (e.g., an environment where the force of gravity is less than that found on Earth).

Some embodiments provide a method for electrocatalytically reducing $CO_2$ to CO, comprising: contacting an electrode with $CO_2$; wherein the electrode is in an aqueous solution having a pH from about 6 to about 8, comprising an electrolyte; wherein the electrode comprises multi-walled carbon nanotubes and a transition metal catalyst having formula M(4,4'-R-2,2'-bipyridine)$(CO)_3$X; R is an electron donating group or an electron withdrawing group; X is a halogen, acetonitrile, $CH_3CN$(OTf), or Py(OTf); M is a transition metal; and wherein the transition metal catalyst is dispersed on the surface of the multi-walled carbon nanotubes; and wherein the method is performed at a temperature of from about 5 °C to about 35 °C.

A number of embodiments of the invention have been described. Nevertheless, it will be understood that various modifications may be made without departing from the spirit and scope of the invention. Accordingly, other embodiments are within the scope of the following claims.

EXAMPLES

Materials and Methods

Materials: Chemicals were purchased from Sigma Aldrich and Fisher Scientific and used without further purifications. Multi-walled carbon nanotubes (MWCNT) (>98% carbon basis, O.D.×L 6-13 nm×2.5-20 μm) and graphitized carbon nanofiber (CNF) (iron-free, composed of conical platelets, D×L 100 nm×20-200 μm) were purchased from Sigma Aldrich. Glassy carbon plates (SA-3, 100×100×t3 mm) were purchased from Tokai Carbon and pre-cut to the area 1×2 $cm^2$.

Preparation of glassy carbon electrodes. Tokai glassy carbon plates were polished with an alumina slurry (0.05 μm) with subsequent sonication in water, methanol and acetone. Polished glassy carbon plates were connected to a copper wire using an alligator clip and were covered with an epoxy so that the exposed working area of glassy carbon surface was equal to 1×1 $cm^2$.

Preparation and Characterization of Re(tBu-Bpy)/MWCNT Electrodes.

Re(4,4'-tBu-2,2'-bpy)$(CO)_3$Cl was synthesized according to a previously published procedure. See Smieja J. M.; Kubiak C. P., Re(bipy-tBu)$(CO)_3$Cl-Improved Catalytic Activity for Reduction of Carbon Dioxide: IR-Spectroelectrochemical and Mechanistic Studies. *Inorg. Chem.* 2010, 49 (20), 9283-9289. A solution of Re(tBu-bpy)$(CO)_3$Cl (2.6 mM, 0.7 ml, 1 mg) in ethanol was added to 5 mg MWCNT and 2 mg CNF and sonicated for 5 minutes to disperse MWCNTs. DI water (0.3-0.5 ml) was added to the mixture to promote saturation and faster adsorption of Re(tBu-bpy)$(CO)_3$Cl by carbon nanotubes. The resulting yellow suspension was sonicated for 15 minutes until solution became colorless, which indicated of a complete adsorption of the catalyst by MWCNTs. This suspension was drop-casted onto a polished glassy carbon plate (1×1 $cm^2$) at 60 °C using a hot plate. Electrodes were dried in the oven for 1 hour at 150 °C prior to CV and CPE experiments. Electrodes made of drop-casted Re(tBu-bpy)-MWCNTs dissolved in a water/ethanol mixture tend to form more even surfaces without visible precipitate at the edges, these electrodes crack less frequently in comparison to the electrodes drop-casted from pure ethanol solutions. Sonication in pure ethanol solution without addition of water resulted only in partial adsorption of the catalyst by MWCNTs and therefore precipitation of catalyst agglomerates occurred at the edges of the electrode. When Re(tBu-bpy)$(CO)_3$Cl catalyst was directly drop-casted onto MWCNTs, yellow agglomerates were seen at the surface of MWCNTs. These electrodes performed poorly in comparison to the electrodes prepared from sonicated Re(tBu-bpy)-MWCNTs ethanol/water solutions.

Electrochemistry. All cyclic voltammetry and controlled potential electrolysis (CPE) experiments were conducted using a Gamry Reference 600 potentiostat. A single compartment cell was used in all experiments with Re(tBu-bpy)/MWCNT/GCE as the working electrode (area 1×1 $cm^2$), A Pt wire spool was used as a counter electrode and Ag/AgCl as a reference electrode. Electrochemical $CO_2$ reduction experiments were performed on a Schlenk line using $N_2$ or $CO_2$ gas. Typically, a 0.5 M $KHCO_3$ solution in DI water was used as the supporting electrolyte. All experiments were conducted with the compensation for iR drop. CPE experiments were performed in a single compartment Gamry cell, with modified carbon electrodes as working, Ag/AgCl as reference and Pt wire spool separated from the working electrode with a glass frit as the counter electrode. Products were monitored using gas chromatograph (Hewlett-Packard 7890A) with a molecular sieves column and helium as carrier gas. Gas analysis was performed using 1 ml gas-tight syringe with the gas sample taken from the headspace of the CPE cell. All potentials were measured versus Ag/AgCl electrode and converted to RHE according to the Nernst equation. Thus, the optimal operating potential of −0.56 V vs. RHE was determined as follows from cells employing Ag/AgCl reference electrodes:

$$E_{RHE}=E_{Ag/AgCl}+0.059\text{pH}+E^{\circ}_{Ag/AgCl}$$

$$E_{RHE}=(-1.20)+0.059\times 7.23+0.1976=-0.56\text{ V}$$

where $E_{RHE}$ is the converted potential vs RHE, $E_{Ag/AgCl}$ is the experimental potential measured against Ag/AgCl reference electrode, and $E^{0}_{Ag/AgCl}$ vs NHE is 209 mV (3 M NaCl) at 25 °C.

Example 1: X-Ray Photoelectron Spectroscopy (XPS)

Figure 4A:
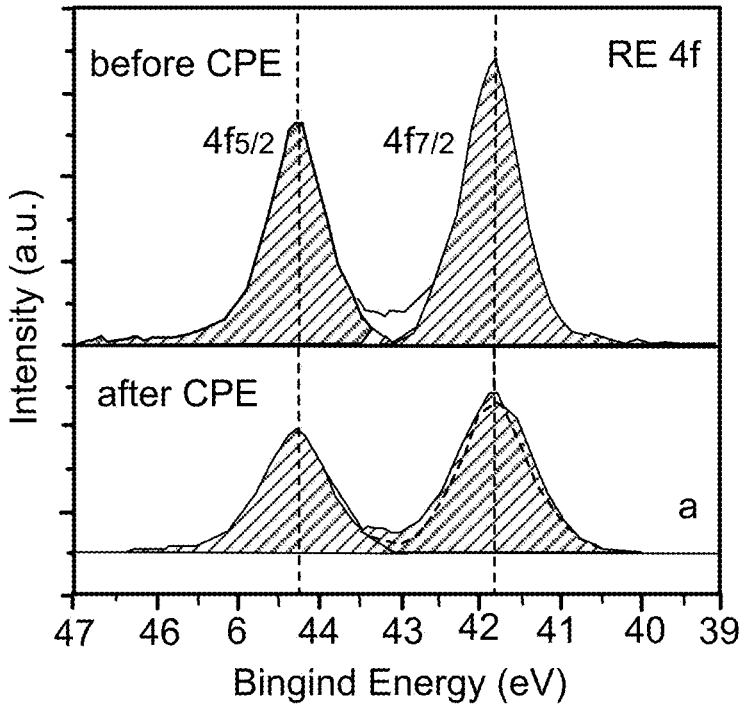
FIG. 4A is an X-ray photoelectron spectrum (XPS) of Re 4f peak of freshly prepared Re-tBu/MWCNT and Re-tBu/MWCNT after 1 h controlled potential electrolysis (CPE)
Figure 4B:
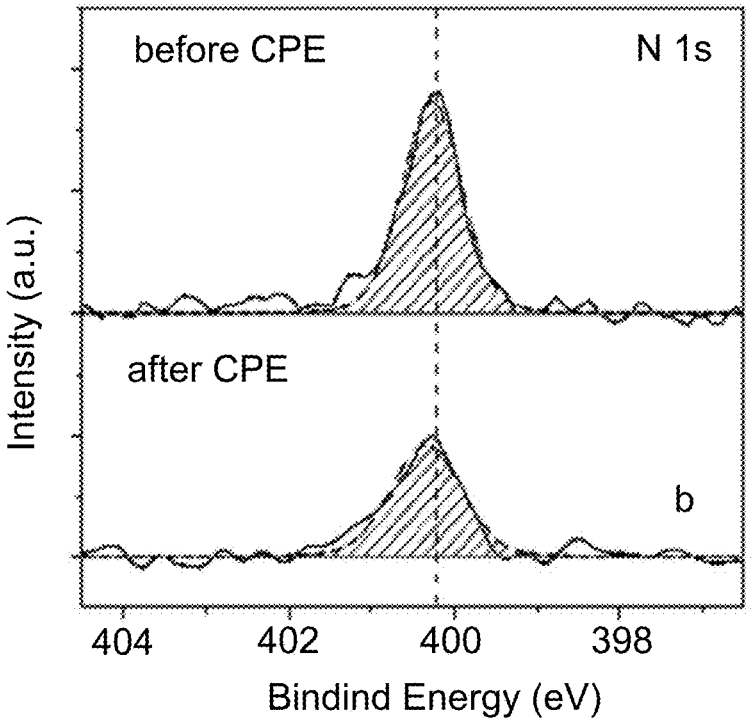
FIG. 4B is an XPS spectrum of N is peak of freshly prepared Re-tBu/MWCNT and Re-tBu/MWCNT after 1 h CPE experiments.
Figure 4C:
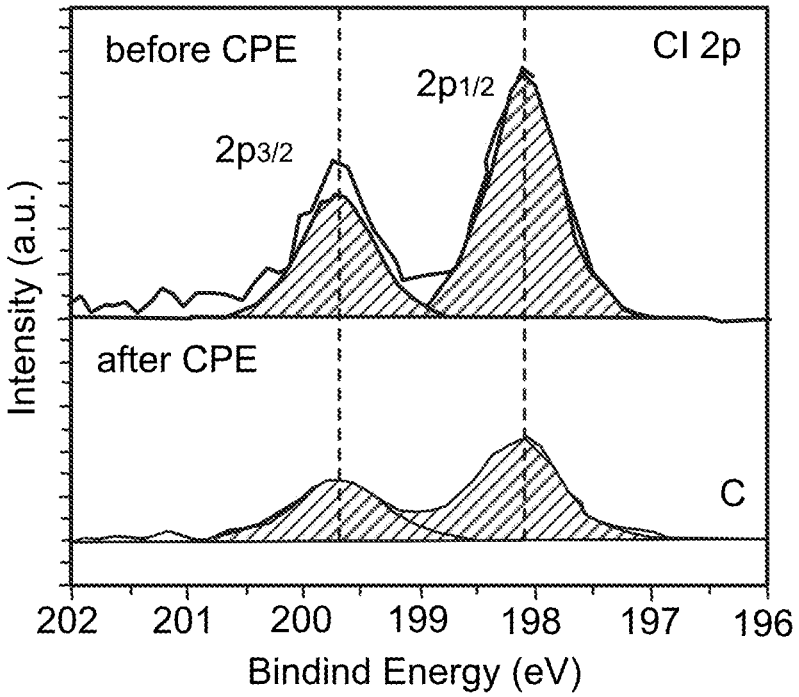
FIG. 4C is an XPS spectrum of Cl 2p peak of freshly prepared Re-tBu/MWCNT and Re-tBu/MWCNT after 1 h CPE experiments.

High-resolution XPS analysis performed before and after 1 h Controlled Potential Electrolysis (CPE) experiments showed Re 4f (rhenium fourth shell f orbital), N Is (nitrogen first shell s orbital), and Cl 2p (chlorine second shell p orbital) peak of freshly prepared Re-tBu/MWCNT and Re-tBu/MWCNT after 1 h CPE experiments (see FIG. 4). The Re 4f spectrum consisted of sharp peaks Re $4f_{5/2}$ and $4f_{7/2}$ at 44.3 and 41.8 eV respectively, with full widths at half-maximum (fwhm) of 1.09.1.09 eV respectively, indicating a homogeneous environment around the rhenium center (FIG. 4A). No peaks were observed at 40.3, 42.7 eV expected for $Re^0$ nanoparticles. The N is spectra consist of a single sharp peak at 400.29 eV (fwhm 0.98 eV) for the sample before CPE and slightly shifted N Is peak at 400.35 eV (fwhm 0.98 eV) for the sample after 1 h CPE (FIG. 4B). The Cl 2p peaks were detected at 198.0 eV for Cl $2p_{1/2}$ and 199.7 eV for Cl $2p_{3/2}$ (FIG. 4C) for the sample before CPE and broader Cl 2 p peaks at 198.2 and 199.7 eV after CPE. XPS of blank Re(tBu-bpy)$(CO)_3$Cl on GCE without MWCNT presence revealed Re 4 f peaks at 44.0 and 41.6 eV. The Cl 2p peaks were detected at 198.7 eV for Cl $2p_{1/2}$ and 200.3 eV Cl $2p_{3/2}$). The N is spectra consist of a single sharp peak at 400.19 eV (fwhm 0.98 eV).

Figure 11A:
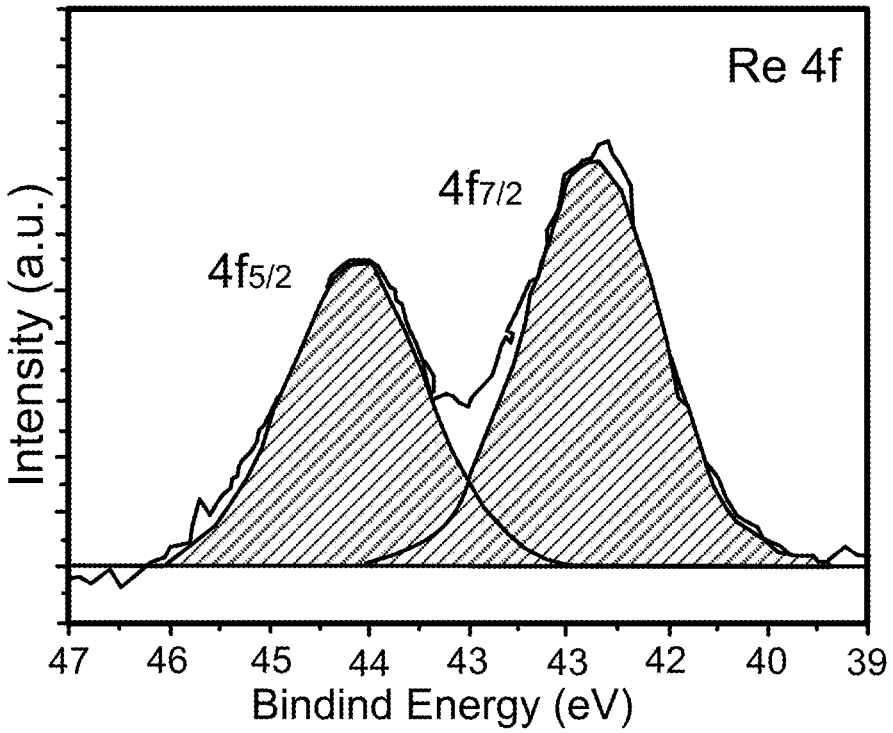
FIG. 11A depicts a high resolution spectrum of the Re 4f peak on bare GCE (carbon fabric).
Figure 11B:
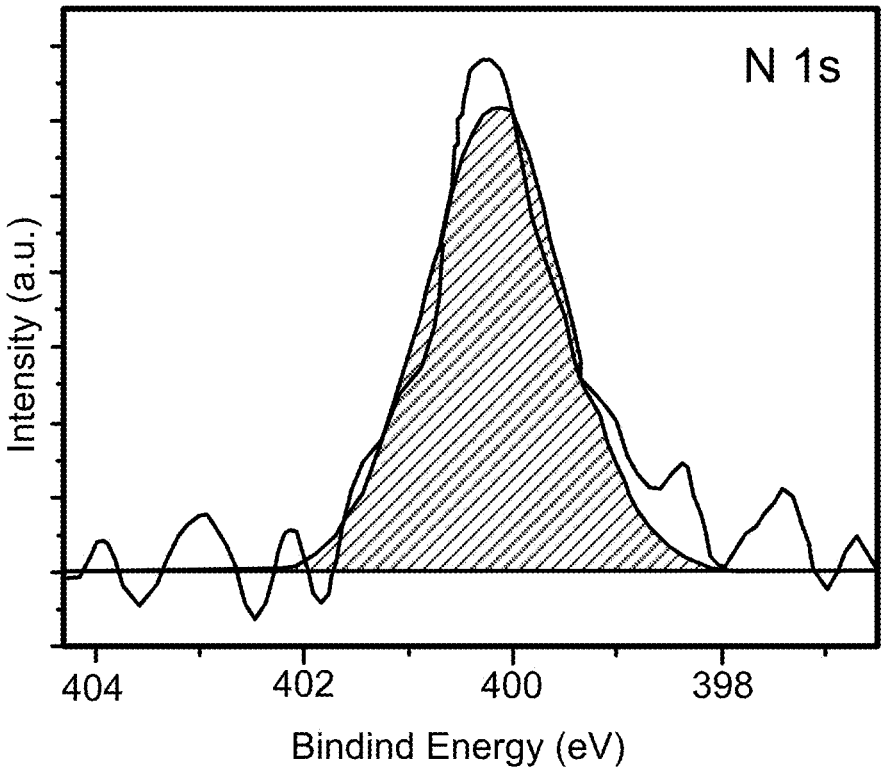
FIG. 11B depicts a high resolution spectrum of the N is peak on bare GCE.
Figure 11C:
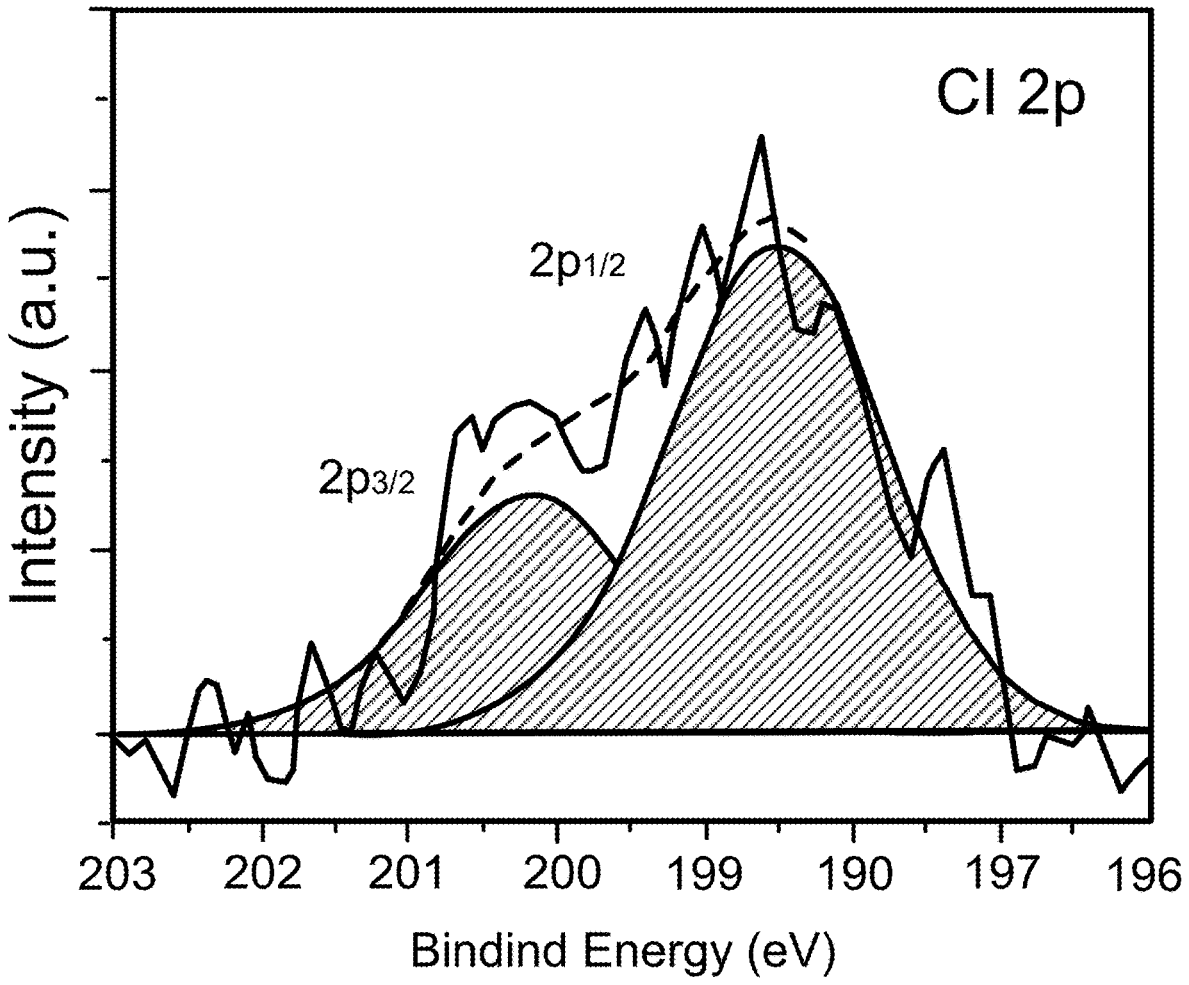
FIG. 11C depicts a high resolution spectrum of the Cl 2p peak on bare GCE.
Figure 12:
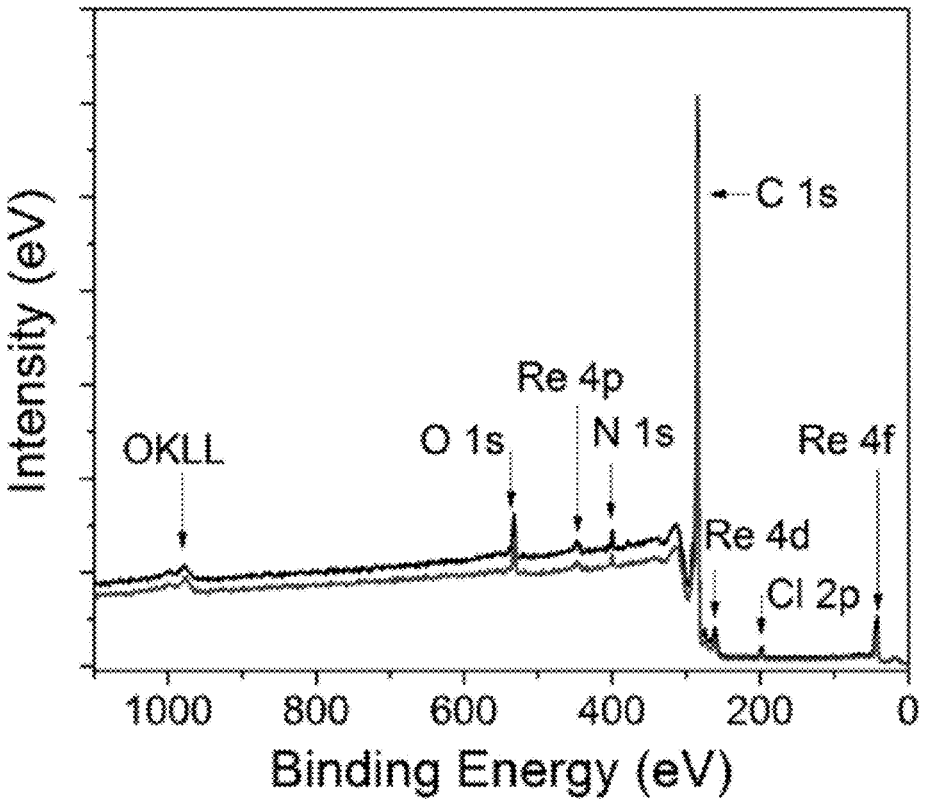
FIG. 12 depicts a survey XPS for Re (tBu-bpy)/MWCNT. The top line on the left is before CPE, and the bottom line on the left is after CPE.

A series of XPS experiments were performed using a Kratos AXIS-SUPRA instrument equipped with a AL K-alpha monochromatic X-ray source operating at 225 W. A pass energy of 160 eV was used for survey spectrum with 1 eV step size and a pass energy of 20 eV was used for details spectra, averaged over 5 scans, with 0.1 eV step size. Data were analyzed with CASA XPS software. All peaks were referenced to the is graphitic carbon peak (284.4 eV) in MWCNT. Peak fittings were performed with a Shirley-type background and Gaussian/Lorentzian line-shapes with 30% Gaussian shape. Survey XPS analysis supports the structural composition of Re(tBu-bpy)$(CO)_3$Cl for freshly prepared samples and for samples measured after CPE experiments. FIGS. 11A-11C depict XPS spectra of freshly prepared samples, wherein the peak integrations reveal atomic surface concentrations of 0.98%, 1.93% and 0.90% for Re (FIG. 11A), N (FIG. 11B), and Cl (FIG. 11C) respectively, which integrates to 1:1.97:0.92, consistent with expected Re/N/Cl ratio of 1:2:1 of Re(tBu-bpy)$(CO)_3$Cl. For samples measured after CPE the atomic surface concentrations are 0.98%, 1.96% and 0.83% for Re, N, and Cl respectively, with Re/N/Cl ratio of 1:2:0.85, indicating a diminished Cl concentration that can be explained by chloride dissociation. Only ca. 7.6% of the Cl content of the samples is lost after CPE. The diminished Cl peak can be explained by chloride dissociation. The dissociation of chloride is consistent with the mechanism for the homogeneous electrochemical reduction of $CO_2$ to CO by Re(t-Bu)$(CO)_3$Cl, where the dissociation of chloride is the initiation step in the catalytic cycle, providing a vacant site for $CO_2$ binding. Table 1 summarizes the survey XPS peak integration. FIG. 12 depicts the survey XPS for Re (tBu-bpy)/MWCNT. The top plot line in FIG. 12 is before CPE, and the bottom plot is after CPE.

TABLE 1

Survey XPS peaks integration.

| Re(tBu-bpy)$(CO)_3$Cl/MWCNT | Re % | N % | C % | O % | Cl % |
|---|---|---|---|---|---|
| before CPE | 0.98 | 1.93 | 93.76 | 2.45 | 0.90 |
| after CPE | 0.98 | 1.96 | 93.63 | 2.64 | 0.83 |
| Re(tBu-bpy)/GCE | 1.08 | 2.07 | 74.49 | 21.38 | 0.99 |

Example 2: $^1$H NMR Analysis

Figure 23:
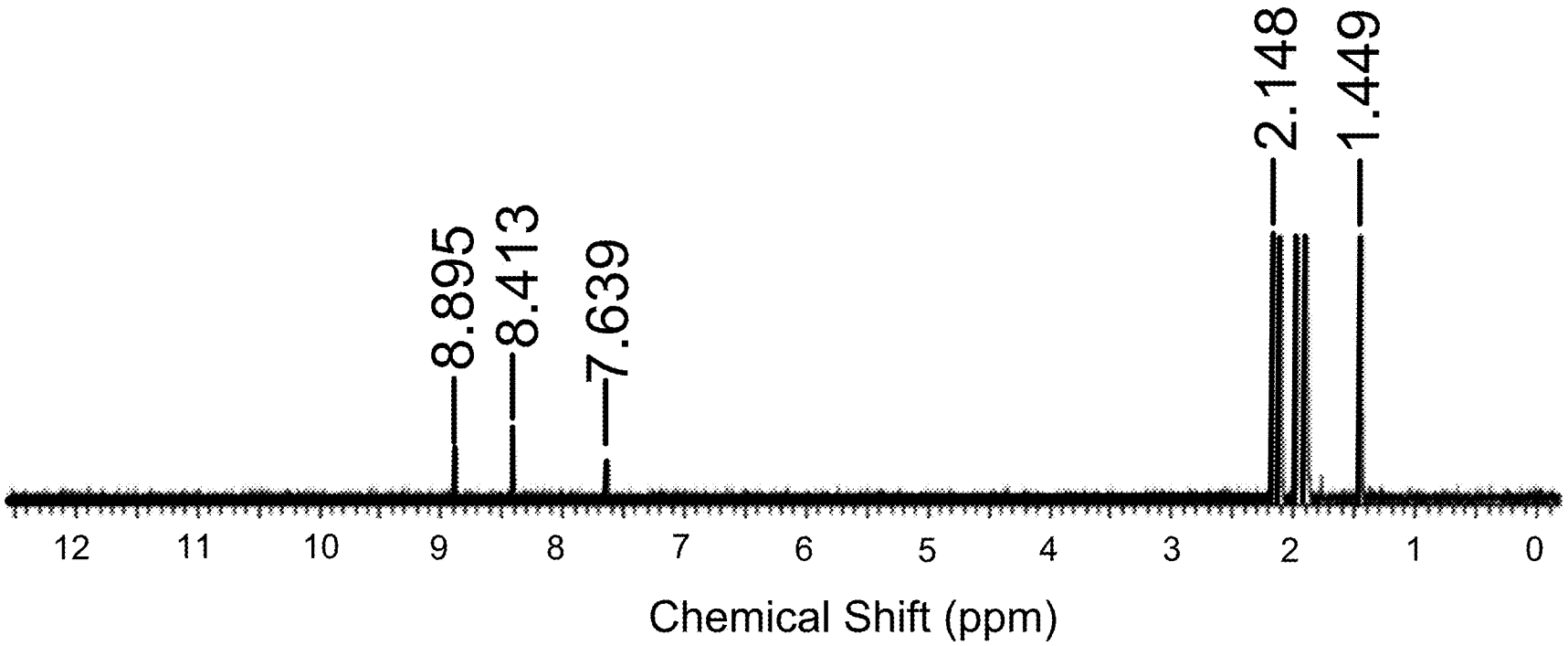
FIG. 23 depicts the $^1$H NMR spectrum of Re(tBu-bpy) MWCNT electrode soaked in $CD_3CN$.

To analyze the composition of electrodes after CPE samples were soaked in deuterated acetonitrile and analyzed via $^1$H NMR spectroscopy. Chemical shifts corresponding to bipyridine ligand were detected and matched with the spectra of Re(tBu-bpy)$(CO)_3$Cl. $^1$H NMR (400 MHz, $CD_3CN$): δ 1.45 (s, 18H, tBu), 7.64 (dd, 2H), 8.41 (d, 2H), 8.88 (d, 2H). FIG. 23 depicts the $^1$H NMR spectrum of Re(tBu-bpy) MWCNT electrode soaked in $CD_3CN$.

Example 3: IR Analysis

Figure 24:
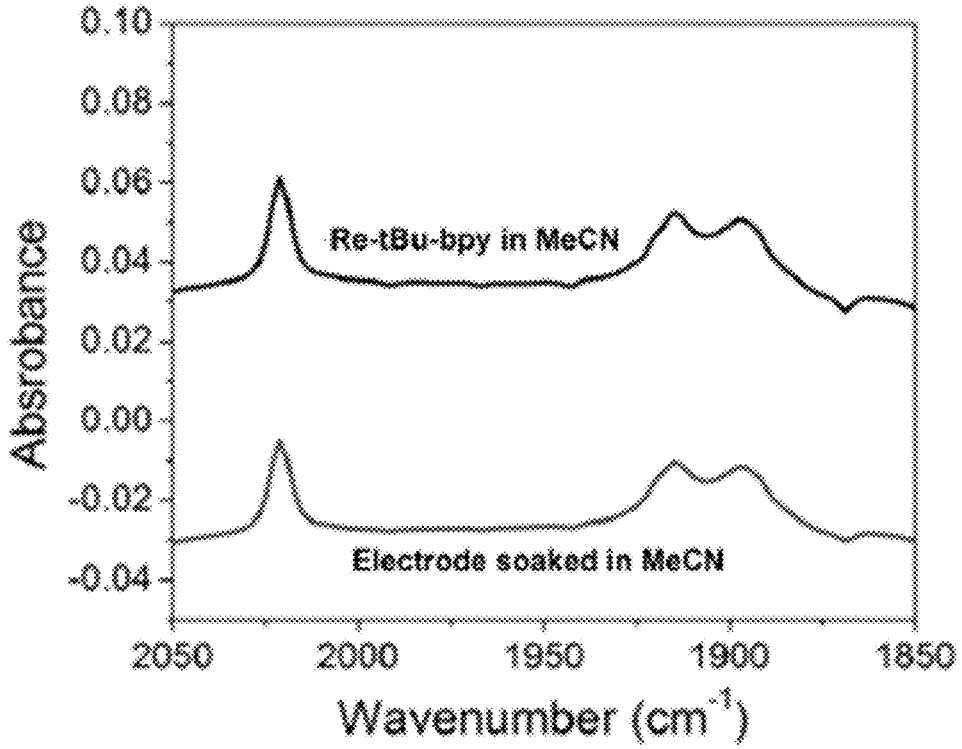
FIG. 24 depicts an infrared (IR) spectrum of Re(tBu-bpy)$(CO)_3$Cl and Re(tBu-bpy)/MWCNT.

Solution IR. The IR experiments of the electrodes soaked in MeCN showed IR peaks ν(CO) 2023, 1916, 1898 $cm^{-1}$ and matched with the IR spectra of Re(tBu-bpy)$(CO)_3$Cl. FIG. 24 depicts an IR spectrum of Re(tBu-bpy)$(CO)_3$Cl (upper plot) dissolved in MeCN and Re(tBu-bpy)/MWCNT dissolved in MeCN (lower plot).

Figure 25A:
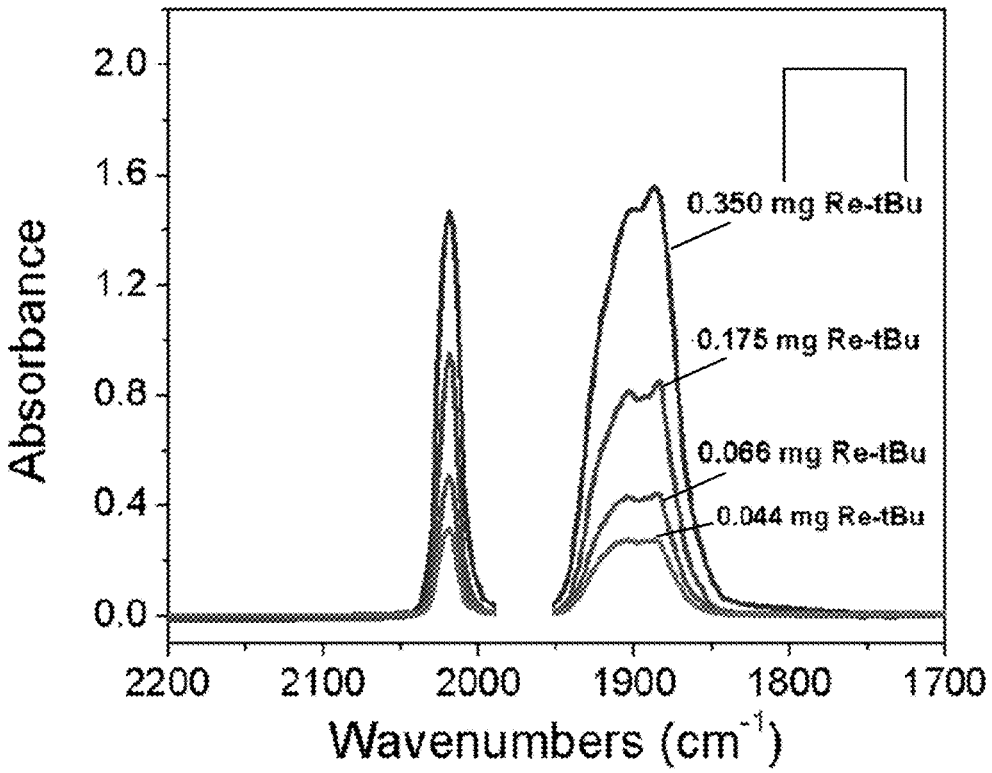
FIG. 25A depicts the calibration IR spectra of Re(tBu-bpy)$(CO)_3$Cl in a KBr pellet.
Figure 25B:
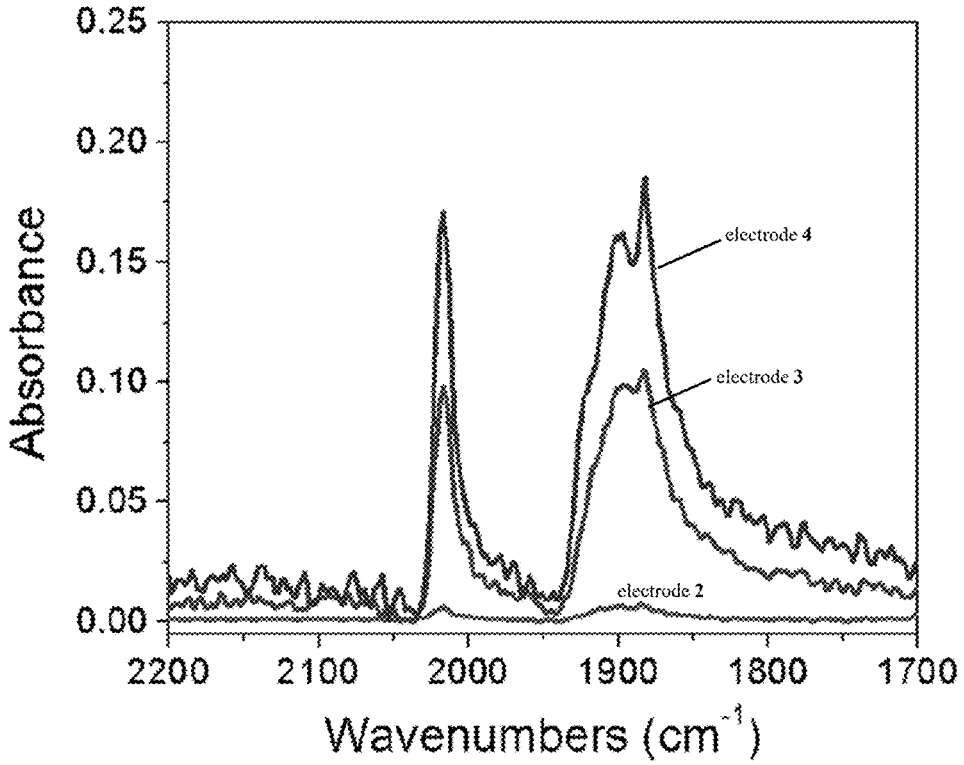
FIG. 25B depicts IR spectra of Re-(tBu-bpy)/MWCNT in KBr pellet collected from electrode 2, electrode 3, and electrode 4.

KBr pellet IR. A sample of Re(tBu-bpy)$(CO)_3$Cl of a known mass was pressed into a pellet with KBr salt and was analyzed using infrared spectroscopy. The IR spectra showed CO peaks at ν(CO) 2017, 1903, 1884 $cm^{-1}$. These pellets with four known concentrations were used as a standard to plot a calibration line for the future measurements. FIG. 25A depicts the calibration IR spectra of Re(tBu-bpy)$(CO)_3$Cl in a KBr pellet; first (uppermost) plot at 1900 $cm^{-1}$ corresponds to 0.350 mg Re-tBu, second plot at 1900 $cm^{-1}$ corresponds to 0.175 mg Re-tBu, third plot at 1900 $cm^{-1}$ corresponds to 0.066 mg Re-tBu, and fourth (lowest) plot at 1900 $cm^{-1}$ corresponds to 0.044 mg Re-tBu. The solid samples of Re(tBu-bpy)/MWCNT with various Re(tBu-bpy)$(CO)_3$Cl loadings were pressed into KBr pellets to perform IR experiments of Re(tBu-bpy)$(CO)_3$Cl adsorbed on MWCNTs. These samples were prepared by mixing electrode materials scraped from the electrode surface with a surgical blade with dry KBr salt. The IR spectra of these samples matched with a standard and showed three CO stretches at 2019, 1900, 1884 $cm^{-1}$. FIG. 25B depicts IR spectra of Re-(tBu-bpy)/MWCNT in KBr pellet collected from electrode 2 (lowest plot at 1900 $cm^{-1}$), electrode 3 (middle plot at 1900 $cm^{-1}$) and electrode 4 (highest plot at 1900 $cm^{-1}$). Catalyst concentrations for three different Re(tBu-bpy)/MWCNT samples were calculated and are listed in Tables 2 and 3.

TABLE 2

IR data of $Re(tBu\text{-}bpy)(CO)_3Cl$ in KBr pellet.

| Adsorption | | | Extinction coefficient | | | Mass |
|---|---|---|---|---|---|---|
| 1884 | 1903 | 2019 | E 1884 | E 1898 | E 2019 | (mg) |
| 1.556 | 1.478 | 1.467 | 19.142 | 18.182 | 18.047 | 0.350 |
| 0.837 | 0.811 | 0.821 | 20.593 | 19.954 | 20.200 | 0.175 |
| 0.429 | 0.420 | 0.458 | 21.110 | 20.667 | 22.537 | 0.088 |

TABLE 3

IR data of $Re(tBu\text{-}bpy)(CO)_3Cl$/MWCNT in KBr pellet.

| Adsorption | | | Extinction coefficient | | | Mass |
|---|---|---|---|---|---|---|
| 1884 | 1903 | 2019 | E 1884 | E 1898 | E 2019 | (mg) |
| 0.008 | 0.007 | 0.008 | 20.68 | 21.25 | 21.10 | 0.06 |
| 0.11 | 0.098 | 0.098 | 20.68 | 21.25 | 21.10 | 0.84 |
| 0.19 | 0.17 | 0.18 | 20.68 | 21.25 | 21.10 | 1.77 |

Example 4: Transmission Electron Microscopy (TEM)

Figure 5:
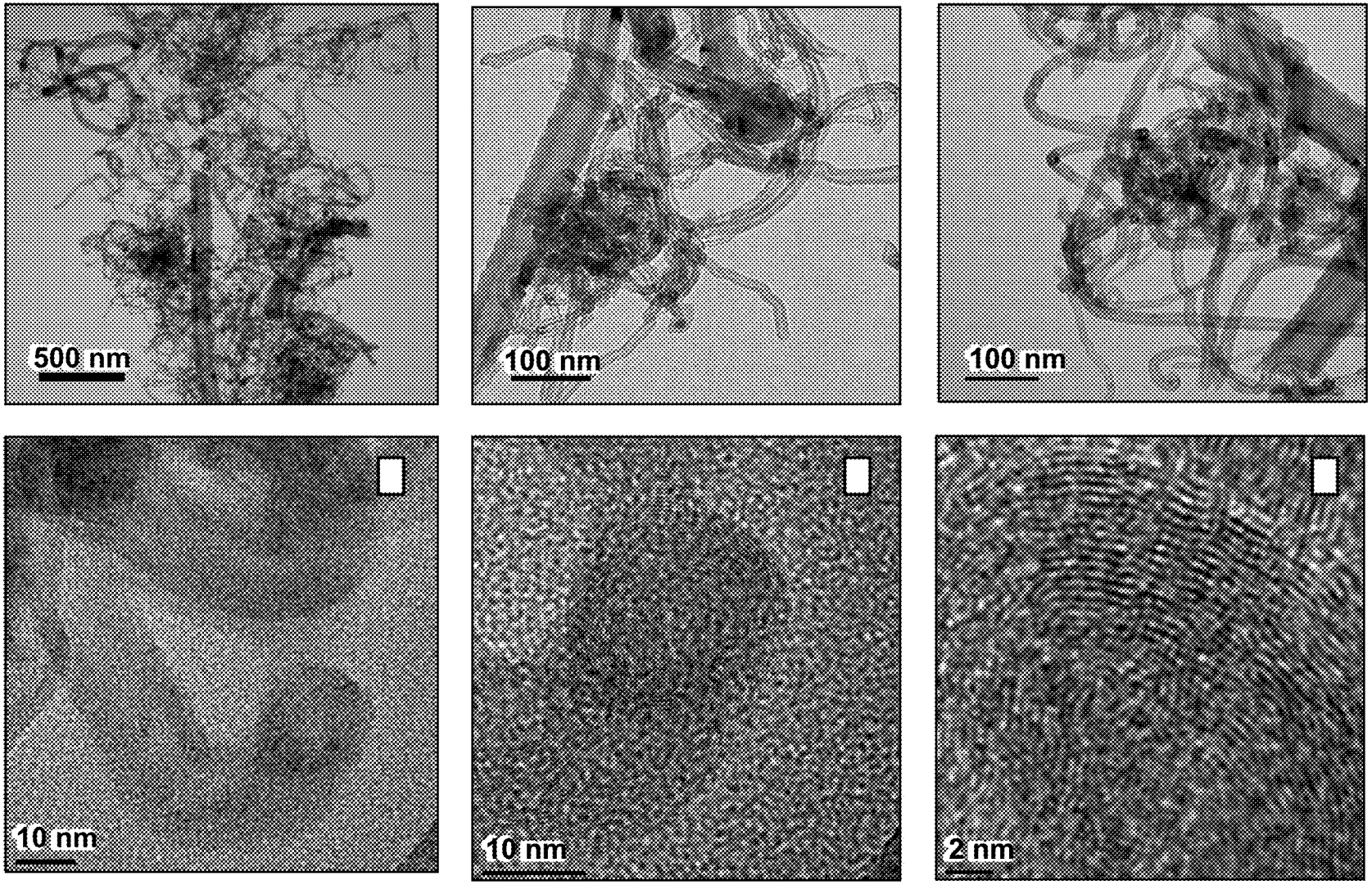
FIG. 5 depicts transmission electron microscopy (TEM) images of Re(tBu-bpy)/MWCNT at different magnifications.

Transmission electron microscopy (TEM) was conducted to study the structural morphology of the electrodes. FIG. 5 depicts TEM images of Re(tBu-bpy)/MWCNT at 25 kX magnification (electrode 3, first row left), 100 kX magnification (electrode 2, first row middle and electrode 3, first row right), 150 kX magnification (electrode 3, second row left), 280 kX magnification (electrode 3, second row middle), and 690 kX magnification (electrode 3, second row right). TEM revealed that Re(tBu-bpy)/MWCNT electrodes consist of hollow tubular nanotubes and conical nanofibers with the average diameter of 15 nm for nanotubes and 35 nm for nanofibers. The slightly wrinkled sidewalls of both carbon nanotubes and nanofibers suggest that the tubes are loaded with the catalyst that is homogeneously distributed over the surface of the nanotubes. The TEM at magnification of 100 k× showed MWCNTs aggregated around CNFs which appear to add stability to the electrode material.

Example 5: Scanning Transmission Electron Microscopy (STEM)/Energy-Dispersive X-Ray Spectroscopy (EDS)

Figure 13A:
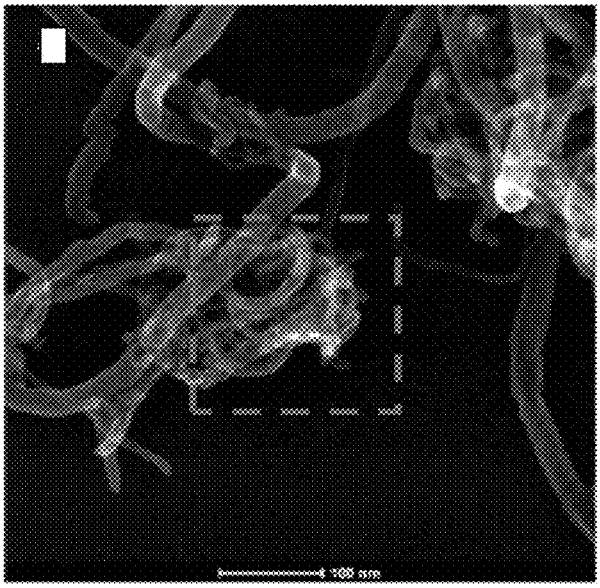
FIG. 13A depicts a scanning transmission electron microscopy (STEM) map of a Re-tBu/MWCNT material.
Figure 13B:
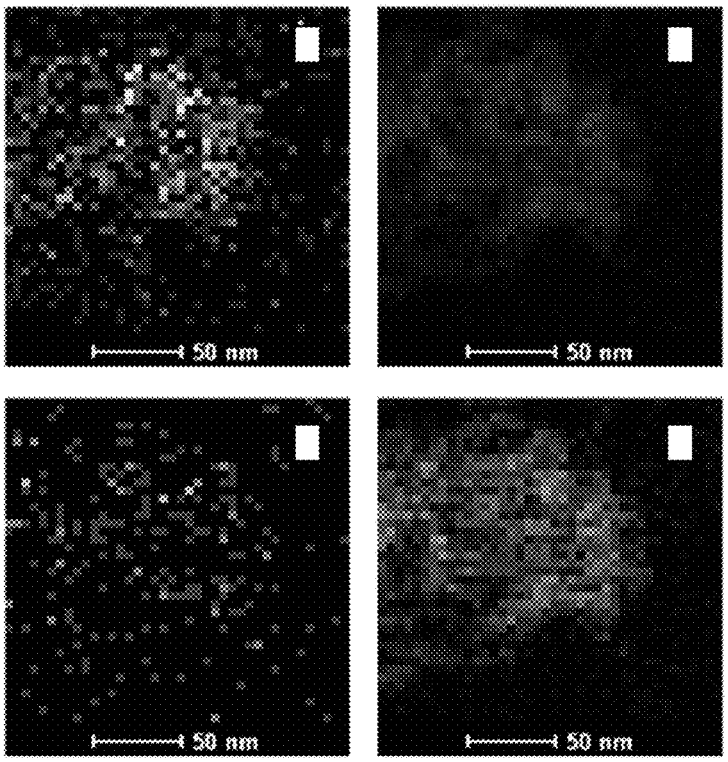
FIG. 13B depicts energy-dispersive X-ray spectroscopy (EDS) maps of rhenium (top left), carbon (top right), chlorine (bottom left), and nitrogen (bottom right).

FIG. 13A depicts a scanning transmission electron microscopy (STEM) of a Re-tBu/MWCNT material and FIG. 13B depicts energy-dispersive X-ray spectra (EDS) of rhenium (upper left), carbon (upper right), chlorine (lower left), and nitrogen (lower right). FIGS. 13A-B revealed a homogeneous distribution of Re throughout the nanotube structures. The distribution of C and N elements matches that of the nanotube structures and overlaps due to close X-ray energies of C (0.277) and N (0.392). The EDS maps of Re and Cl show some response outside of the carbon nanotubes structures due to the instrumental noise that is typical at this magnification.

Example 6: Cyclic Voltammetry (CV)

Figure 2:
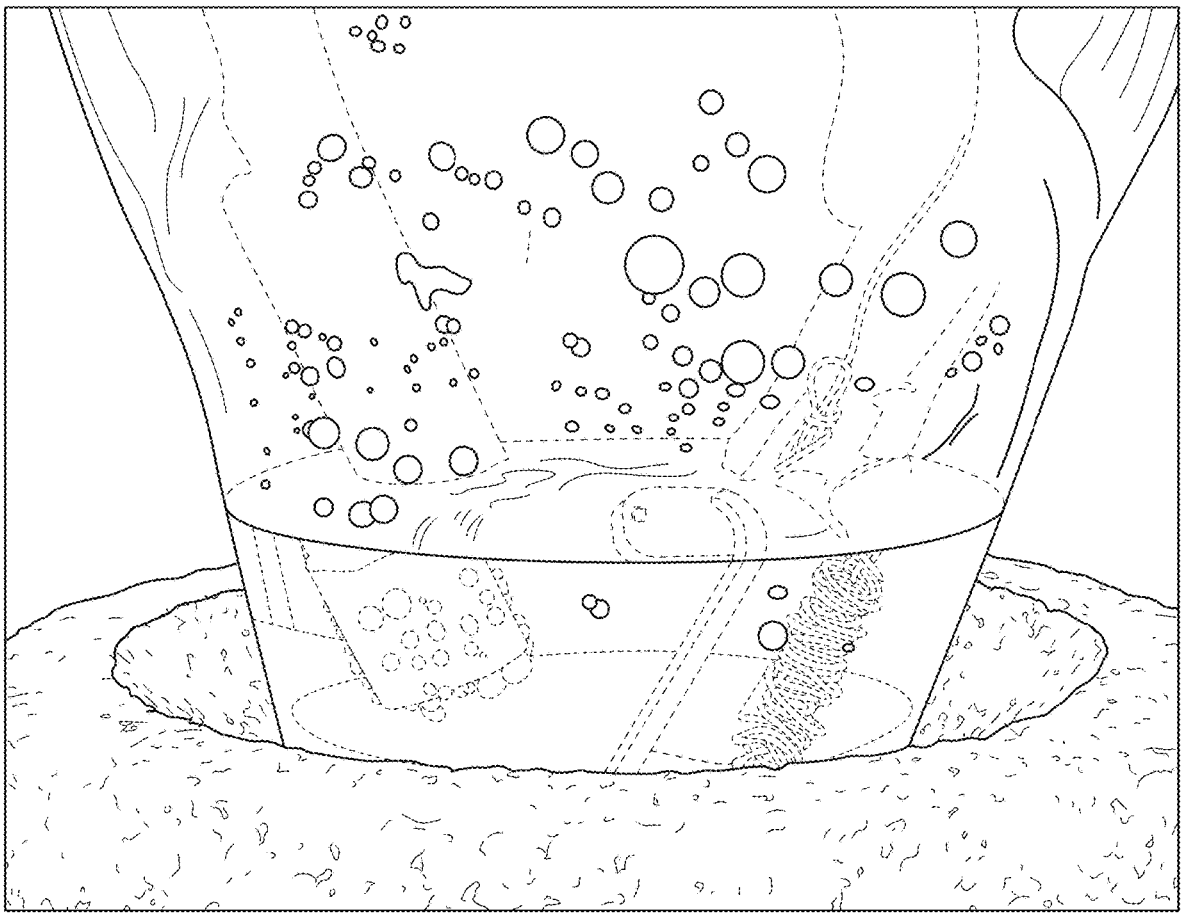
FIG. 2 is an image of an exemplary electrochemical cell in operation.
Figure 3:
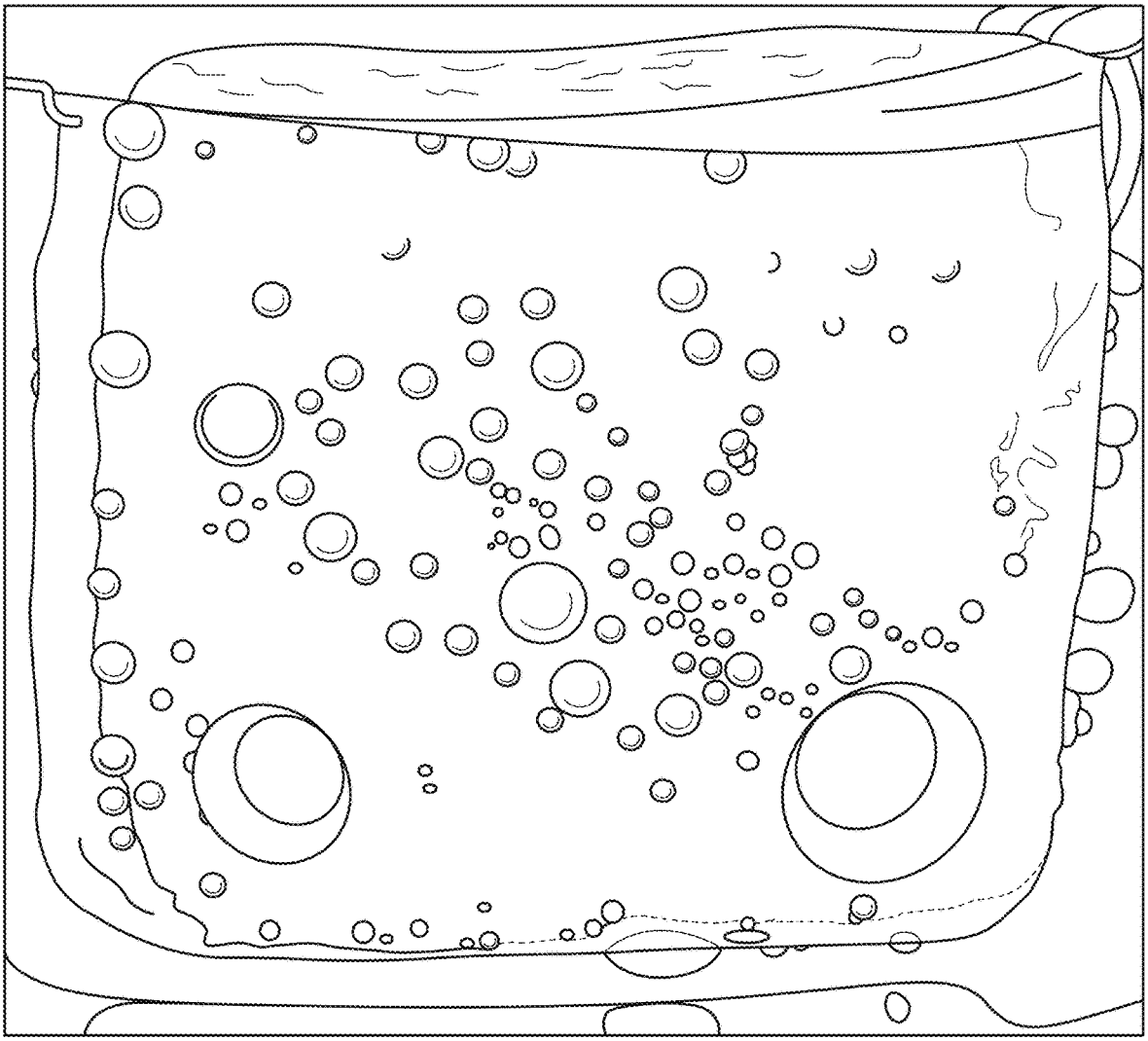
FIG. 3 is an image of the electrode surface.
Figure 6:
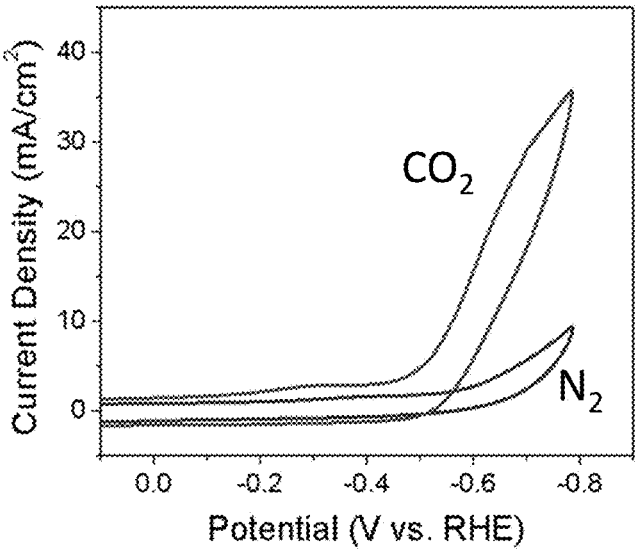
FIG. 6 depicts a cyclic voltammetry (CV) spectrum of Re(tBu-bpy)/MWCNT under $N_2$ (lower curve) and $CO_2$ (upper curve) in 0.5 M $KHCO_3$ taken prior to the CPE experiment, using a scan rate of 100 mV/sA.
Figure 14:
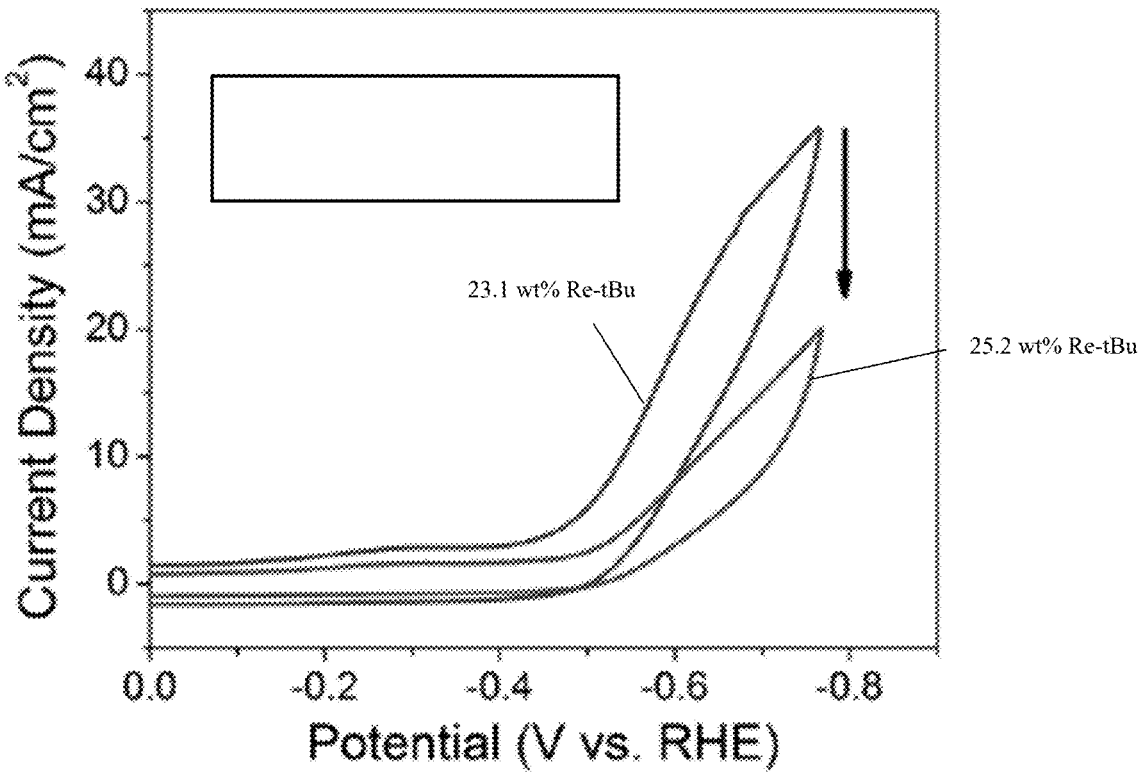
FIG. 14 depicts a CV spectrum of Re(tBu-bpy)/MWCNT electrodes 4 and 5 in 0.5 M $KHCO_3$ under $CO_2$.

The cyclic voltammetry (CV) experiments were performed using a three electrodes cell configuration, with platinum as a counterelectrode, Ag/AgCl as a reference and modified Re(tBu-bpy)/MWCNT as the working electrode at 100 mV/s. FIG. 2 is an image of an exemplary electrochemical cell in operation. FIG. 3 is an image of the electrode surface upon which CO bubbles have formed. CV experiments were performed in 0.5 M $KHCO_3$ under $N_2$ or $CO_2$ atmosphere, unless stated otherwise. Electrodes with various Re(tBu-bpy) loadings were investigated through CV and CPE experiments and the results are summarized in Table 4. FIG. 6 depicts a CV spectrum of Re(tBu-bpy)/MWCNT under $N_2$ (lower curve) and $CO_2$ (upper curve) in 0.5 M $KHCO_3$ taken prior to the CPE experiment, using a scan rate of 100 mV/sA. A significant increase in current is observed when the applied potential reached −0.56 V vs. RHE under $CO_2$ in comparison to $N_2$ atmosphere. Current densities of 30 $mA/cm^2$ were achieved with electrodes containing 23.008 wt % of catalyst. The current density was found to decrease with decreasing catalyst loading and was less than 10 $mA/cm^2$ for electrode 1. FIG. 14 depicts a CV spectrum of Re(tBu-bpy)/MWCNT electrodes 4 and 5 in 0.5 M $KHCO_3$ under $CO_2$; Re(tBu-bpy)/MWCNT electrodes were used as working electrode, Ag/AgCl as a reference electrode, and Pt as a counter electrode. The scan rate was 100 mV/s. The upper curve is 23.1 wt % Re-tBu and the lower curve is 25.2 wt % Re-tBu. Oversaturation of the carbon nanotube surface was found to occur when catalyst loading exceeded the concentration of 25 wt %, and this resulted in diminished current during CV and CPE experiments.

TABLE 4

Summary of electrocatalytic $CO_2$ reduction using Re(tBu-bpy)/MWCNT electrodes.

| Electrode No. | Re(tBu-bpy) (wt %) | Charge (C) | [CO] (μmol) | FE (% CO) | FE (% $H_2$) | TOF ($h^{-1}$) | $TON_{EA}$ (CV) | $TOF_{EA}$ (CV)($s^{-1}$) | I ($mA/cm^2$) |
|---|---|---|---|---|---|---|---|---|---|
| 1 | 0.42 | 3.7 | 16 | 84 | 15 | 297 | 2280 | 0.6 | 1.0 |
| 2 | 2.50 | 4.6 | 21 | 94 | 5 | 124 | 2703 | 0.8 | 1.3 |
| 3 | 13.9 | 11.1 | 57 | 99 | 1 | 38 | 5161 | 1.4 | 3.1 |
| 4 | 23.1 | 14.4 | 73 | 99 | 1 | 27 | 5619 | 1.6 | 4.0 |
| 5 | 25.2 | 7.6 | 33 | 99 | 1 | 12 | 4013 | 1.1 | 2.1 |

Example 7: Inductively Coupled Plasma-Mass Spectrometry (ICP-MS)

ICP-MS was performed on electrodes 1-5. The results of the analysis are shown in Table 5.

TABLE 5

Results of ICP-MS analysis of Re(tBu-bpy)/MWCNT.

| Electrode # | Re(tBu-bpy)/ MWCNT mg | Re mg | Re wt % | Re(tBu-bpy) mg | Re(tBu-bpy) wt % |
|---|---|---|---|---|---|
| 1 | 7.1 | 0.01 | 0.14 | 0.03 | 0.42 |
| 2 | 4.8 | 0.04 | 0.83 | 0.10 | 2.50 |
| 3 | 6.2 | 0.28 | 4.52 | 0.86 | 13.87 |
| 4 | 6.8 | 0.51 | 7.50 | 1.57 | 23.08 |
| 5 | 6.6 | 0.54 | 8.18 | 1.66 | 25.15 |

Example 8: Controlled Potential Electrolysis (CPE)

Figure 7:
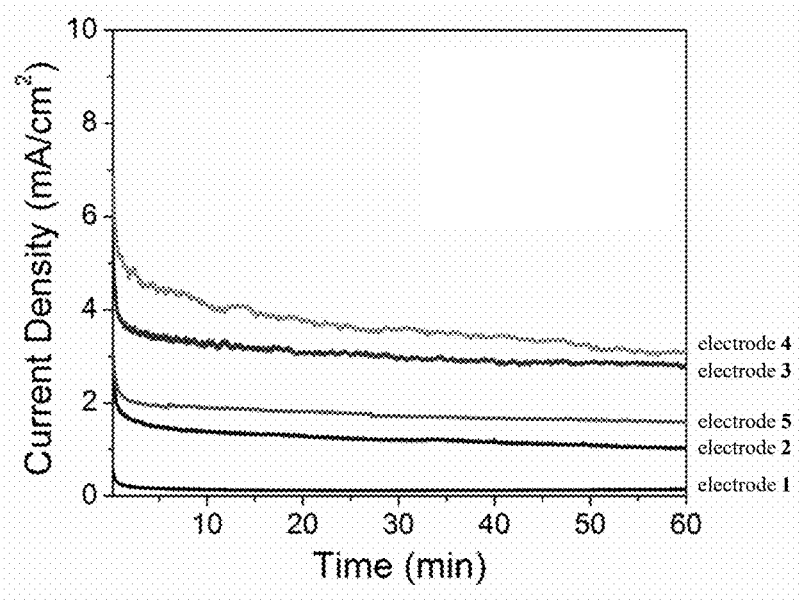
FIG. 7 depicts CPE experiments of Re(tBu-bpy)/MWCNT electrodes in $CO_2$ saturated 0.5 M $KHCO_3$ at −0.56 V vs. RHE for electrodes 1-5.
Figure 8:
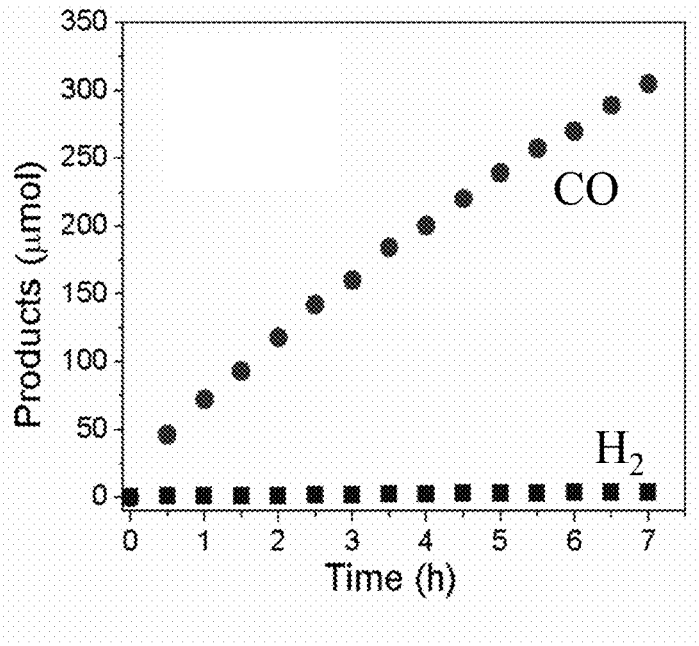
FIG. 8 is a plot showing the product distribution between CO and $H_2$ measured as a function of time for a 7 h CPE experiment with a Re(tBu-bpy)/MWCNT (electrode 4) at −0.56 V vs. RHE in 0.5 M $KHCO_3$.
Figure 26:
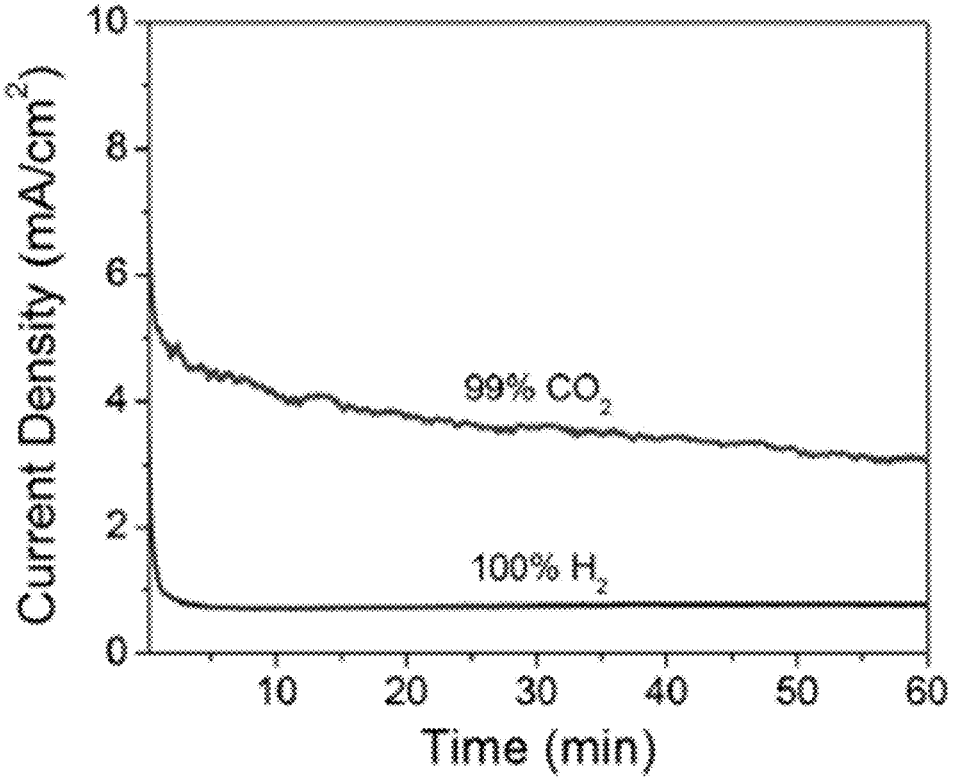
FIG. 26 depicts CPE of Electrode 4 under $N_2$ vs. $CO_2$. at −0.56 V vs. RHE in 0.5 M$KHCO_3$.

The composition, quantity, and rate of the product formation was investigated via controlled potential electrolysis (CPE) experiments. CPE experiments were performed in a three-neck cell (V=89 ml) at −0.56 V vs. RHE in 0.5 M $KHCO_3$ solution (35-40 ml) saturated with $CO_2$ gas. Under these conditions in the absence of the catalyst bare MWCNTs on a glassy carbon electrode produced $H_2$ with 100% Faradaic efficiency and very low current densities (0.18 mA/cm$^2$). When loaded with Re(tBu-bpy), these electrodes displayed high current densities which were found to be dependent on the catalyst loading. FIG. 7 depicts CPE experiments of Re(tBu-bpy)/MWCNT electrodes in $CO_2$ saturated 0.5 M $KHCO_3$ at −0.56 V vs. RHE. A current density of 1.0 mA/cm$^2$ was achieved with electrode 1 (0.42 wt % Re-tBu, bottom plot), 1.3 mA/cm$^2$ was achieved with electrode 2 (2.5 wt % Re-tBu, fourth plot from top), 3.1 mA/cm$^2$ for electrode 3 (13.9 wt % Re-tBu, second plot), and reached the maximum of 3.8 mA/cm$^2$ for electrode 4 (23.1 wt % Re-tBu, first (highest) plot). A decline in current density was observed for electrode 5, when catalyst loadings exceeded 25 wt % (third plot) suggesting that these electrodes are susceptible to a blocking effect at higher catalyst loadings. An electrode including 0% Re-tBu produced the fifth (lowest) plot. This was somewhat surprising since a Re catalyst loading of 25 wt % corresponds approximately to one Re atom per 170 carbon atoms in the hybrid material. The headspace was analyzed via gas chromatography after 1 h of electrolysis and revealed Faradaic efficiency (FE) of 99% for CO and less than 1% $H_2$ for the electrodes 3, 4, and 5. The selectivity for CO decreased when the catalyst loadings were decreased and corresponded to FE(CO) of 97% for electrodes 7 (4.1 wt %) and 8 (6.7 wt %) and reached FE(CO) of 94% for electrode 2 and 6 (2.8 wt %) (see Tables 4 and 6). When the loading of the catalyst was decreased to 0.42% (electrode 1) the selectivity for CO decreased to 84%. The performance of electrode 4 was further investigated and CPE experiments were performed that proceeded for 7 hours at −0.56 V vs. RHE in 0.5 M $KHCO_3$ solution saturated with $CO_2$ gas. The headspace analysis via gas chromatography was performed every half hour. FIG. 8 shows the product distribution between CO (circular data points) and $H_2$ (square data points) measured as a function of time for a 7 h CPE experiment with a Re(tBu-bpy)/MWCNT (electrode 4) at −0.56 V vs. RHE in 0.5 M $KHCO_3$, revealing that the Faradaic efficiency of 99% for CO remained constant throughout the course of the experiment without deactivation of the catalyst. Table 7 shows CPE data for the 7 hour experiment in $CO_2$-saturated 0.5 M $KHCO_3$. FIG. 26 depicts CPE of Electrode 4 under $N_2$ vs. $CO_2$. at −0.56 V vs. RHE in 0.5 M $KHCO_3$. Due to rapid CO formation and its low solubility in water, a profusion of CO bubbles was observed on the surface of the electrodes during CPE experiments.

TABLE 6

Summary of electrocatalytic $CO_2$ reduction using Re(tBu-bpy)/MWCNT electrodes 6-8.

| Electrode # | Re(tBu-bpy) (wt %) | Charge (C) | [CO] (μmol) | FE (% CO) | FE (% $H_2$) | TOF ($h^{-1}$) | I (mA/cm$^2$) |
|---|---|---|---|---|---|---|---|
| 6 (0.20 mg)* | 2.8 | 7.3 | 35 | 94 | 6 | 101 | 2.0 |
| 7 (0.30 mg)* | 4.1 | 8.7 | 44 | 97 | 3 | 83 | 2.4 |
| 8 (0.50 mg)* | 6.7 | 10.2 | 51 | 97 | 3 | 60 | 2.9 |

*TOF calculated based on the total mass of the sample.

TABLE 7

CPE data for the 7-hour experiment in $CO_2$ saturated 0.5M $KHCO_3$.

| | | Gc area | | mol CO | | current efficiency % | | | | TON | TOF (h-1) |
|---|---|---|---|---|---|---|---|---|---|---|---|
| time (h) | Coulombs | $H_2$ | CO | $H_2$ | CO | $H_2$ | CO | total | Electrons | mol | CO/molCat |
| 0.5 | 9.00 | 1.68 | 220.00 | 5.46−07 | 4.60E-05 | 1.2% | 99.4% | 100.5% | 9.33E−05 | 16.94 | 33.89 |
| 1.0 | 14.00 | 2.14 | 366.00 | 6.68−07 | 7.20E−05 | 1.0% | 99.2% | 100.2% | 1.45E−04 | 26.32 | 26.33 |
| 1.5 | 18.00 | 3.11 | 481.00 | 9.30−07 | 9.30E−05 | 1.0% | 99.9% | 100.9% | 1.67E−04 | 34.08 | 22.72 |
| 2.0 | 23.00 | 3.78 | 624.00 | 1.11−06 | 1.18E−04 | 0.9% | 99.3% | 100.2% | 2.38E−04 | 43.25 | 21.68 |
| 2.5 | 28.00 | 4.53 | 716.00 | 1,38−06 | 1.42E−04 | 1.0% | 97.7% | 98.7% | 2.90E-04 | 51.84 | 20.73 |
| 3.0 | 33.00 | 5.55 | 826.00 | 1.73−06 | 1.67E−04 | 1.0% | 97.7% | 88.7% | 3.42E−04 | 61.07 | 20.36 |
| 3.5 | 36.00 | 6.48 | 929.00 | 1.98−06 | 1.84E−04 | 1.1% | 88.6% | 99.7% | 3.73E−04 | 87.26 | 19.22 |
| 4.0 | 38.70 | 7.24 | 1025.00 | 2.21−06 | 2.06E−04 | 1.1% | 98.7% | 99.8% | 4.11E−04 | 74.28 | 18.65 |
| 4.5 | 43.30 | 8.12 | 1104.00 | 2.54−06 | 2.23E−04 | 1.1% | 98.5% | 100.8% | 4.49E−04 | 81.63 | 18.14 |
| 5.0 | 46.80 | 8.82 | 1218.00 | 2.70−06 | 2.41E−04 | 1.1% | 89.9% | 101.0% | 4.83E−04 | 88.18 | 17.64 |

TABLE 7-continued

CPE data for the 7-hour experiment in $CO_2$ saturated 0.5M $KHCO_3$.

| | | Gc area | | mol CO | | current efficiency % | | | | TON | TOF (h-1) |
|---|---|---|---|---|---|---|---|---|---|---|---|
| time (h) | Coulombs | $H_2$ | CO | $H_2$ | CO | $H_2$ | CO | total | Electrons | mol | CO/molCat |
| 5.5 | 49.70 | 9.75 | 1298.00 | 2.96−06 | 2.57E−04 | 1.2% | 99.8% | 101.0% | 5.15E−04 | 93.97 | 17.09 |
| 6.0 | 52.80 | 10.44 | 1365.00 | 8.19−06 | 2.70E−04 | 1.2% | 98.8% | 100.0% | 5.47E−04 | 98.82 | 16.47 |
| 6.5 | 55.70 | 11.46 | 1445.00 | 3.51−06 | 2.86E−04 | 1.2% | 99.1% | 100.3% | 5.77E−04 | 104.61 | 16.09 |
| 7.0 | 58.40 | 12.50 | 1523.00 | 3.82−06 | 3.02E−04 | 1.2% | 99.0% | 100.2% | 6.05E−04 | 110.26 | 16.75 |

Further Discussion of CV and CPE Results

The observed high CO:$H_2$ selectivity of Re(tBu-bpy)/MWCNT electrodes is attributed to the high loadings of the Re(tBu-bpy) catalyst used in these experiments. At high concentration and surface coverage, selectivity for CO was almost 100% and remained constant throughout 7 hours of CPE. High surface coverage by the Re catalyst appears to promote $CO_2$ reduction over native proton reduction that can occur at exposed carbon sites. When catalyst loadings were low (electrode 1, 0.7 wt %) hydrogen production was observed to occur with Faradaic efficiency for $H_2$=15% and 84% for CO. When catalyst loadings were increased to 13.9 wt %, selectivity for $H_2$ decreased to <1% with FE=99% for CO. To obtain maximum CO selectivity the Re(tBu-bpy) catalyst should be evenly dispersed onto the structure of MWCNTs to minimize carbon sites exposure. It is understood that minimization of carbon sites exposure suppresses hydrogen formation.

Figure 15A:
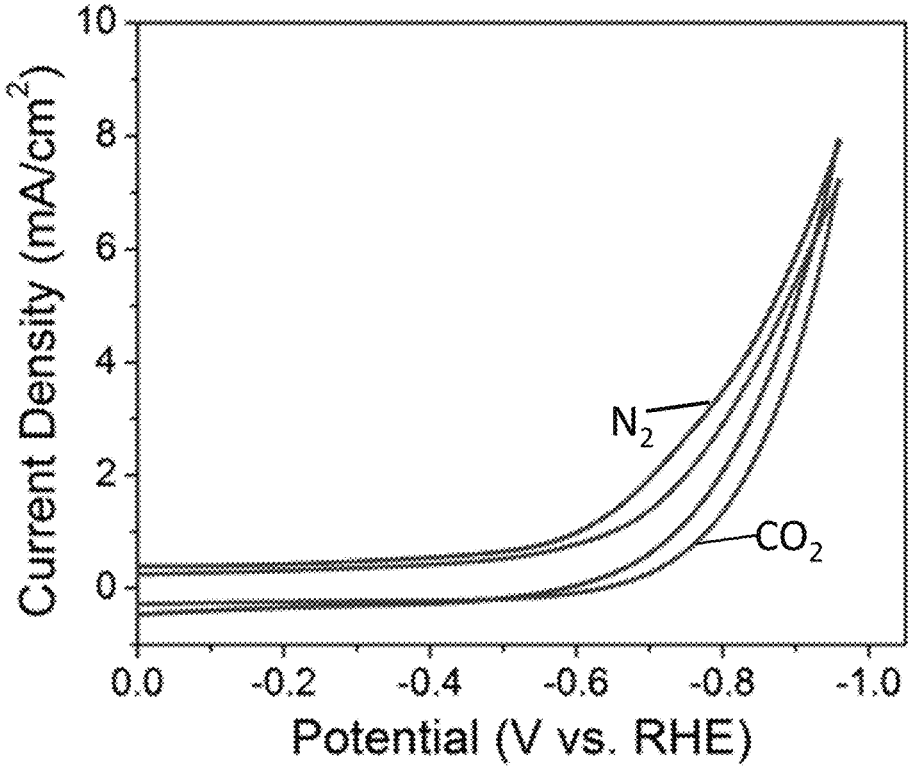
FIG. 15A depicts a CV of control Re(tBu-bpy)/GCE under $N_2$ and under $CO_2$.
Figure 15B:
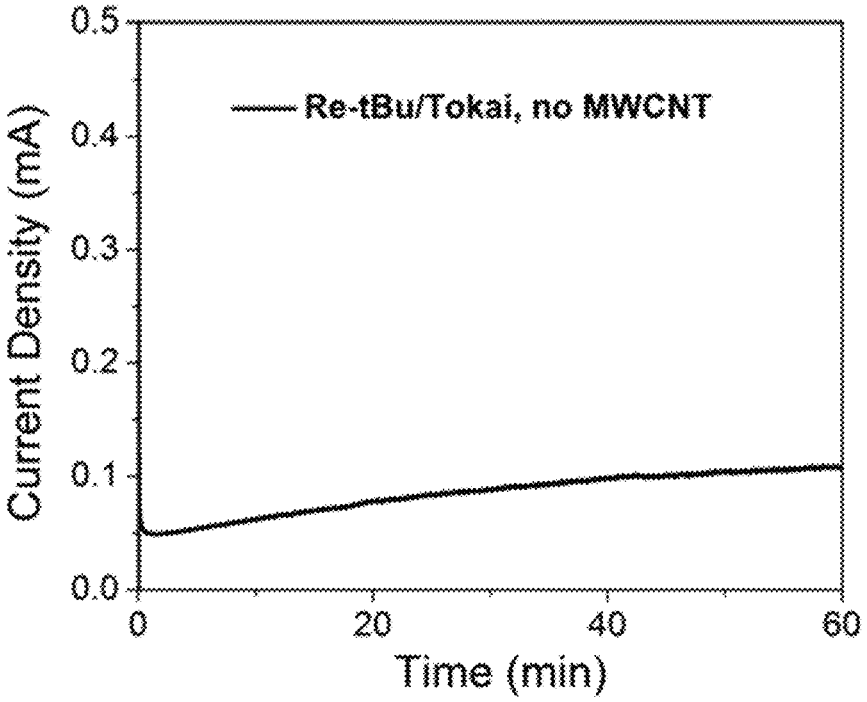
FIG. 15B depicts a CPE of control Re(tBu-bpy)/GCE under $CO_2$ at −0.56 V vs. RHE.
Figure 16:
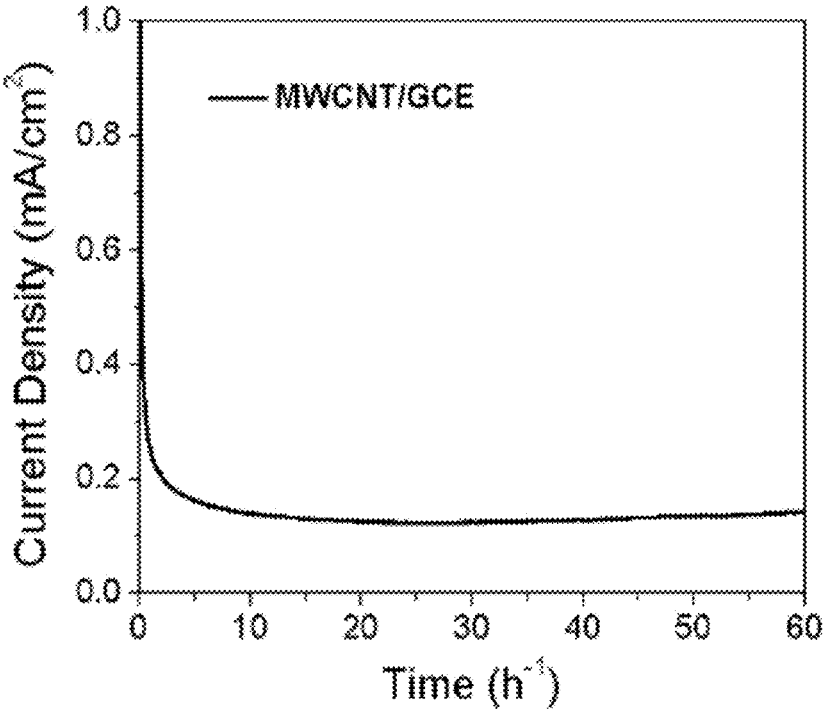
FIG. 16 depicts a CPE of blank MWCNT/GCE under $CO_2$ at −0.56 V vs. RHE.
Figure 17A:
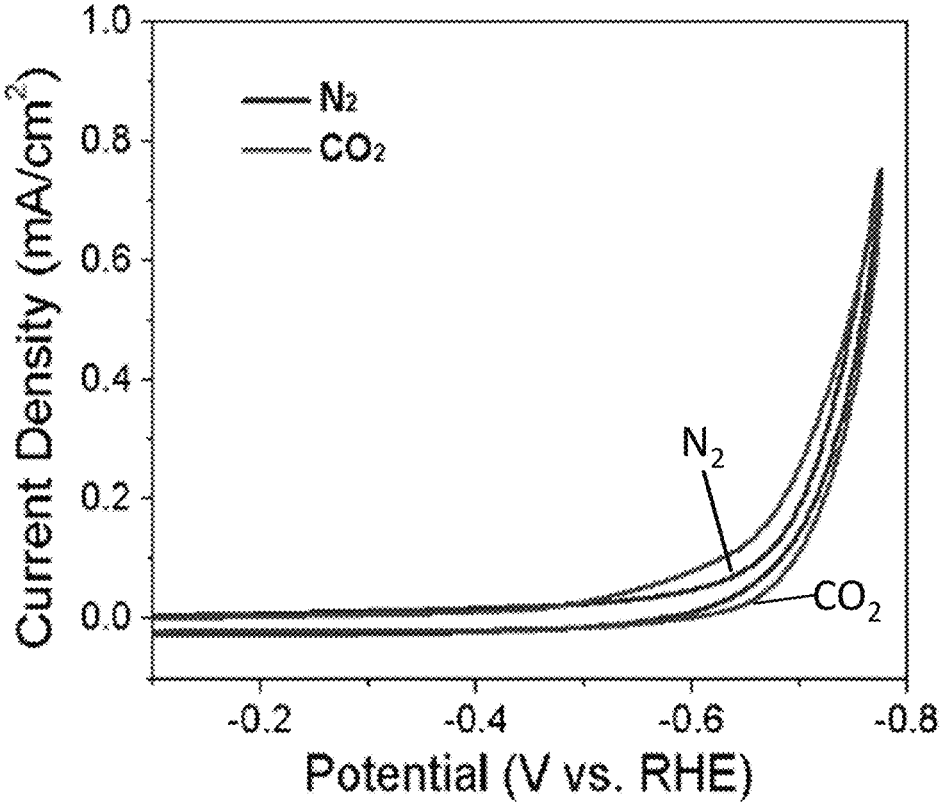
FIG. 17A depicts a CV of Re(tBu-bpy)/CNF (carbon nanofiber) under $N_2$ and under $CO_2$.
Figure 17B:
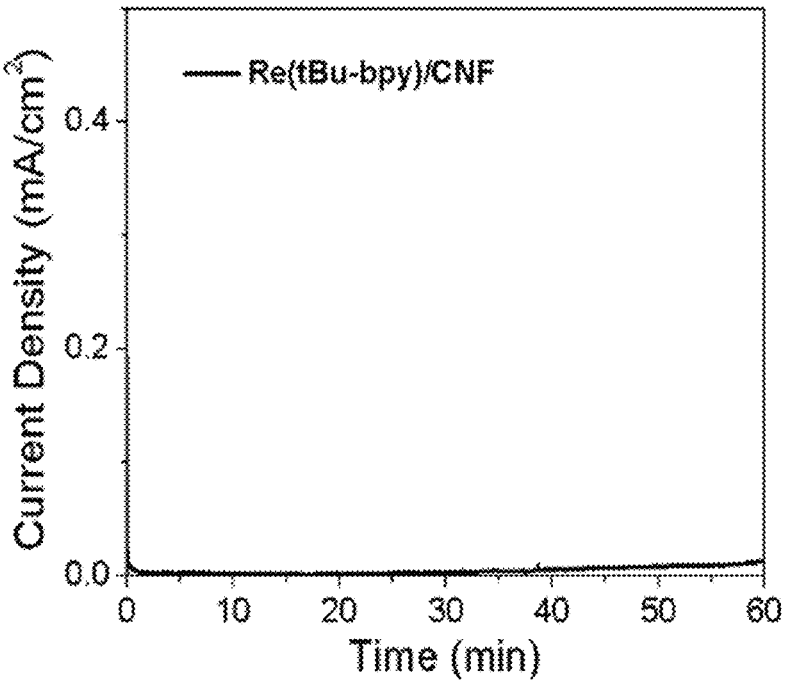
FIG. 17B depicts a CPE of Re(tBu-bpy)/CNF at −0.56 V vs. RHE under $CO_2$ atmosphere.

FIG. 15A depicts a CV of control Re(tBu-bpy)/GCE in 0.5 M $KHCO_3$ under $N_2$ (upper and lower plot at 0.0 potential) and under $CO_2$ (middle two plots at 0.0 potential). FIG. 15B depicts a CPE of control Re(tBu-bpy)/GCE in 0.5 M $KHCO_3$ under $CO_2$ at −0.56 V vs. RHE. The FE ($H_2$) 100%. The control experiments under a nitrogen atmosphere showed production of $H_2$, and no CO formation during CPE experiments. Electrodes without MWCNTs with only Re(tBu-bpy) directly drop casted on glassy carbon surface showed almost no electrochemical activity toward $CO_2$ reduction at the same conditions. FIG. 16 depicts a CPE of blank MWCNT/GCE in 0.5 M $KHCO_3$ under $CO_2$ at −0.56 V vs. RHE. The FE ($H_2$)=100%. This bare MWCNT/GCE without Re(tBu-bpy) showed exclusive production of hydrogen with FE (112)=100%. FIG. 17A depicts a CV of Re(tBu-bpy)/CNF in 0.5 M $KHCO_3$ under $N_2$ (two middle plot lines at −0.7 potential) and under $CO_2$ (highest and lowest plot lines at −0.7 potential). FIG. 17B depicts a CPE of Re(tBu-bpy)/CNF at −0.56 V vs. RHE in 0.5 M $KHCO_3$ under $CO_2$ atmosphere. The electrodes without MWCNTs with only Re(tBu-bpy) directly drop casted on glassy carbon surface showed almost no electrochemical activity towards $CO_2$ reduction under the same conditions. Control CV experiments with CNF demonstrated no change in current under $CO_2$ in comparison to $N_2$ with very low CPE current and hydrogen production with 100% Faradaic efficiency.

Figure 9:
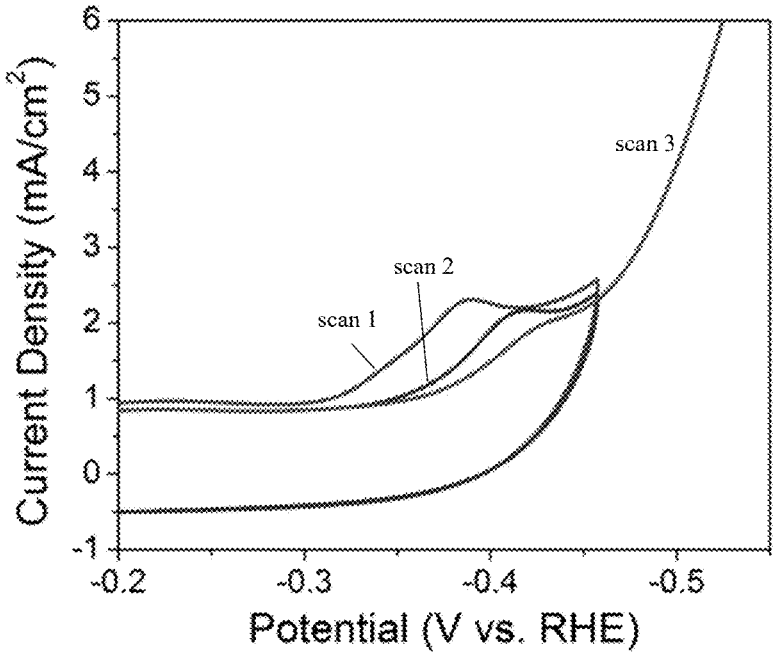
FIG. 9 is depicts a CV plot of Re(tBu-bpy)/MWCNT at 25 mV/s in 0.5 M $KHCO_3$ under $CO_2$ atmosphere using electrode 4 as a working electrode, Ag/AgCl as a reference, and Pt as a counter electrode.

The TOF measured during CPE experiments and calculated per total concentration of catalyst were found to range from 178 $h^{-1}$ to 12 $h^{-1}$, depending on the catalyst loadings. It is important to note that the TOF values were calculated based on the total amount of Re(tBu-bpy) in the bulk material and are therefore the lower limit of the actual catalyst TOF values that should be calculated based on the amount of electroactive catalyst. The amount of electroactive catalyst can be obtained through integration of the area of a Re(tBu-bpy) CV. In acetonitrile Re(tBu-bpy)$(CO)_3$Cl displays two one electron reductions that were previously assigned to a bipyridine-based reduction followed by a metal based $Re^{I/0}$ reduction. FIG. 9 depicts a CV plot of Re(tBu-bpy)/MWCNT at 25 mV/s in 0.5 M $KHCO_3$ under $CO_2$ atmosphere and used electrode 4 as a working electrode, Ag/AgCl as a reference, and Pt as a counter electrode. The scan rate was 25 mV/s. The first scan is the uppermost line at −0.4 V, the second scan is the line immediately below the first scan at −0.4V, and the third scan is the line immediately below the second scan at −0.4V. Re(tBu-bpy) redox peak was detected in 0.5 M $KHCO_3$ at a scan rate of 25 mV/s at −0.38 V vs. RHE, prior to the catalytic wave, for freshly prepared electrodes, when the capacitive current is low. This feature was tentatively assigned to the bipyridine ligand-based redox process (first scan in FIG. 9). The CV peak shifts after the second scan and gets smaller after a third scan and completely diminishes after a fourth scan. The fact that the intensity of the peak decreases and completely vanishes with consecutive scans may indicate strong electronic coupling between MWCNTs under bias and the Re catalyst. The lack of Faradaic current in this case may be due to charge build up at the interface establishing an electric field gradient that changes the Fermi level of the electrode relative to the donor/acceptor states regardless of the applied potential. This eliminates the driving force for the outer-sphere electron transfer consistent with the double-layer theory for a molecule electronically coupled to the electrode. Jackson M. N.; Oh S.; Kaminsky C. J.; Chu S. B.; Zhang G.; Miller J. T.; Surendranath Y., Strong Electronic Coupling of Molecular Sites to Graphitic Electrodes via Pyrazine Conjugation. *J. Am. Chem. Soc.* 2018, 140 (3), 1004-1010. The quantity of electroactive Re(tBu-bpy) for electrode 4 obtained by integration of the first peak area was calculated to be $1.3\times10^{-8}$ mol. This compares to a value of $1.8\times10^{-8}$ for CoPc-CN, and $2\times10^{-9}$ for COF-367-Co. Zhang X., Wu Z., Zhang X., Li L., Li Y., Xu H., Li X., Yu X., Zhang Z., Liang Y., Wang H.,, Highly Selective and Active $CO_2$ Reduction Electro-Catalysts Based on Cobalt Phthalocyanine/carbon Nanotube Hybrid Structures. *Nat. Commun.* 2017, 8, 14675; Lin S., Diercks C. S., Zhang Y. B., Kornienko N., Nichols E. M., Zhao Y., Paris A. R., Kim D., Yang P., Yaghi O. M., Chang C. J., Covalent Organic Frameworks Comprising Cobalt Porphyrins for Catalytic $CO_2$ Reduction in Water. *Science* 2015, 349 (6253), 1208-1213. Using an estimated value of electroactive Re in the Re(tBu-bpy)/MWCNT electrodes, a $TON_{EA}$=5619 and $TOF_{EA}$=1.6 $s^{-1}$ were obtained. The amount of electroactive catalyst was determined for all electrodes in the manner described here and was found to range from 1-8% of the total catalyst loaded into the bulk electrode material. Table 8 provides the CPE current of electroactive species obtained from CV. Charge Q was calculated using the area under the curve per scan rate and moles of electroactive catalyst was calculated according to Equation: $\Gamma=Q/nFA$, where n is the number electrons (n=1), F is the Faraday constant, and A is the area of the electrode.

TABLE 8

Electroactive species obtained from CV and corresponding CPE current.

| Electrode # | $Mol_{EA}$ ($\times 10^{-8}$) | Current Density ($mA/cm^2$) |
|---|---|---|
| 1 | 0.68 | 1.0 |
| 2 | 0.79 | 1.3 |
| 3 | 1.1 | 3.1 |
| 4 | 1.3 | 4.0 |
| 5 | 0.82 | 2.1 |

Figure 18:
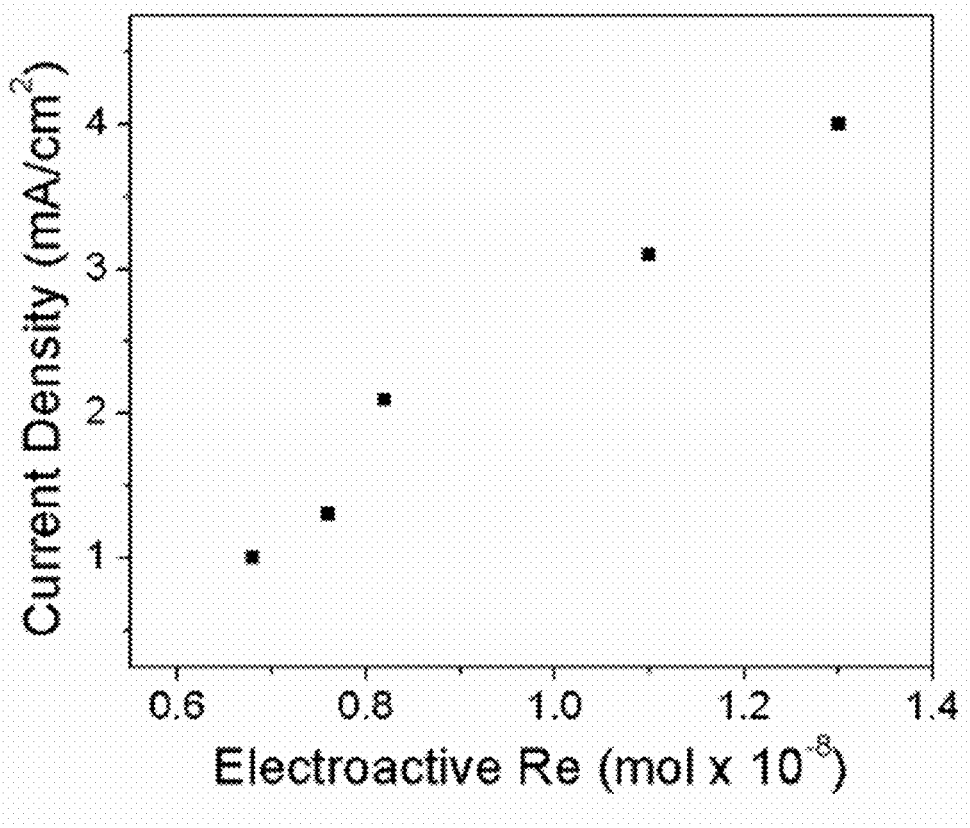
FIG. 18 depicts a plot of CPE current vs. electroactive rhenium.

FIG. 18 depicts a plot of CPE current vs. electroactive rhenium, which shows that the amount of electroactive rhenium increased with increasing catalyst loadings until it reached a saturation level (electrode 5) which is attributed to the formation of agglomerates of inactive catalyst and physical blocking of the electrode surface. Thus, the amount of electroactive Re for electrode 5 decreased, which was also reflected in lower current densities for this electrode. The $TOF_{EA}$ values for all electrodes are summarized in Table 1. Although high surface coverage resulted in lower amounts of electroactive catalyst, the total coverage is necessary to suppress the competing hydrogen evolution reaction that occurs on the exposed sites of the carbon nanotubes.

Figure 19:
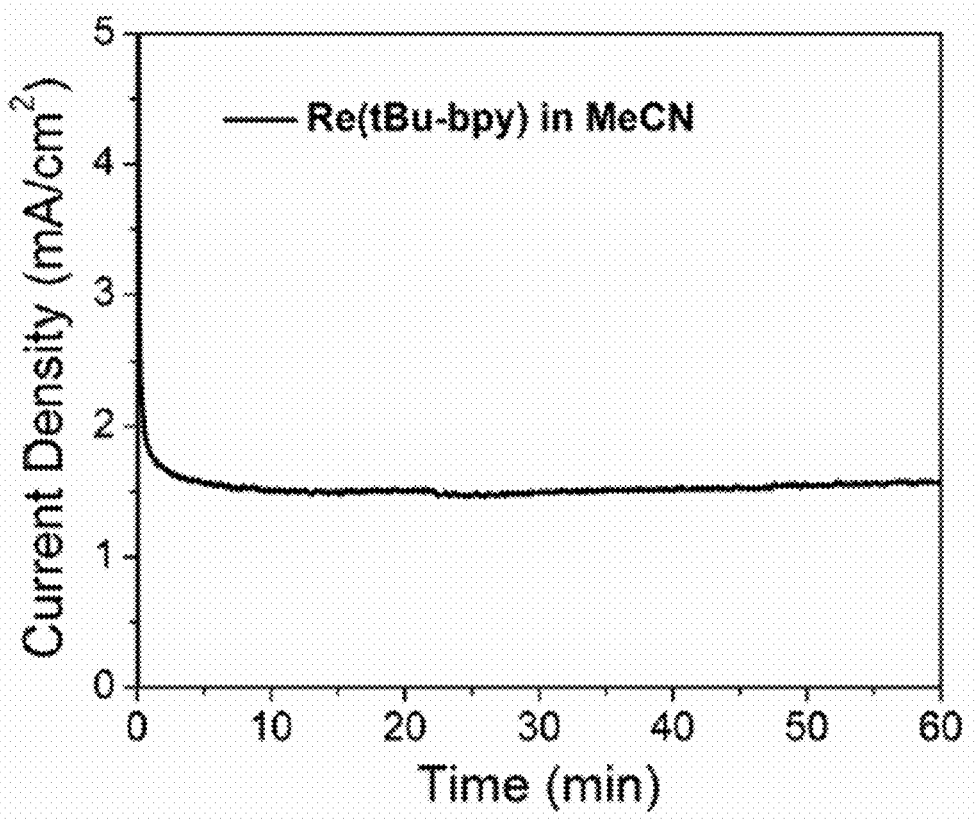
FIG. 19 depicts a CPE of 0.1 mM Re(tBu-bpy)$(CO)_3$Cl at −2.1 V vs. $Fc^{+/0}$ in $CO_2$ saturated MeCN/5% $H_2O$ solution.

The TOF for homogeneous $CO_2$ reduction by 1 mM Re(tBu-bpy)$(CO)_3$Cl in acetonitrile in the presence of 3 M $H_2O$ corresponds to TOF=5.7 $s^{-1}$ (average), with a maximum reported TOF of 2601 $s^{-1}$ for 10 M $H_2O$. Smieja J. M.; Sampson M. D.; Grice K. A.; Benson E. E.; Froehlich J. D.; Kubiak C. P., Manganese as a Substitute for Rhenium in $CO_2$ Reduction Catalysts: The Importance of Acids. *Inorg. Chem.* 2013, 52, 2484-2491. The maximum effective loading for heterogeneous Re(tBu-bpy)/MWCNT was 23 wt %, which at the operating conditions corresponds to 0.1 mM Re(tBu-bpy), loadings 10 times lower than that for homogeneous catalysis. It is worth noting that these electrodes operate in aqueous media where the solubility of $CO_2$ is almost 5 times lower than in acetonitrile. FIG. 19 depicts a CPE of 0.1 mM Re(tBu-bpy)$(CO)_3$Cl at −2.1 V vs. $Fc^{+/0}$ in $CO_2$ saturated MeCN/5% $H_2O$ solution; 0.1 M $TBAPF_6$ was used as electrolyte; bare MWCNT/CNF/GCE was used as a working electrode; Ag/AgCl was used as a reference; and Pt was used as a counter electrode. The control CPE experiments depicted in FIG. 19 exhibited hydrogen production with FE of 87% and FE of 12% for CO. This was attributed to the limited diffusion and mass transport of the catalyst to the highly porous surface of the MWCNT. When incorporated into the structure of the MWCNT catalyst material no such limitations are observed because of the direct contact between the catalyst and the surface of the electrode.

Without addition of Bronsted acids, but in the presence of advantageous water, the determined overpotential (η) of Re(4,4'-tBu-bpy)$(CO)_3$Cl is equal to 0.856 V, considering $CO_2$/CO equilibrium at −1.344 V vs. $Fc^{+0.36}$ Since in aqueous solutions $CO_2$/CO equilibrium corresponds to −0.11 V vs. RHE, (Chen Y.; Li C. W.; Kanan M. W., Aqueous $CO_2$ Reduction at Very Low Overpotential on Oxide-Derived Au Nanoparticles. *J. Am. Chem. Soc.* 2012, 134, 19969-19972) the reduction potential of −0.56 V vs. RHE is equal to the overpotential of 0.45 V for CO evolution, which is 0.41 V lower than η for the homogeneous Re catalyst in acetonitrile.

Figure 20:
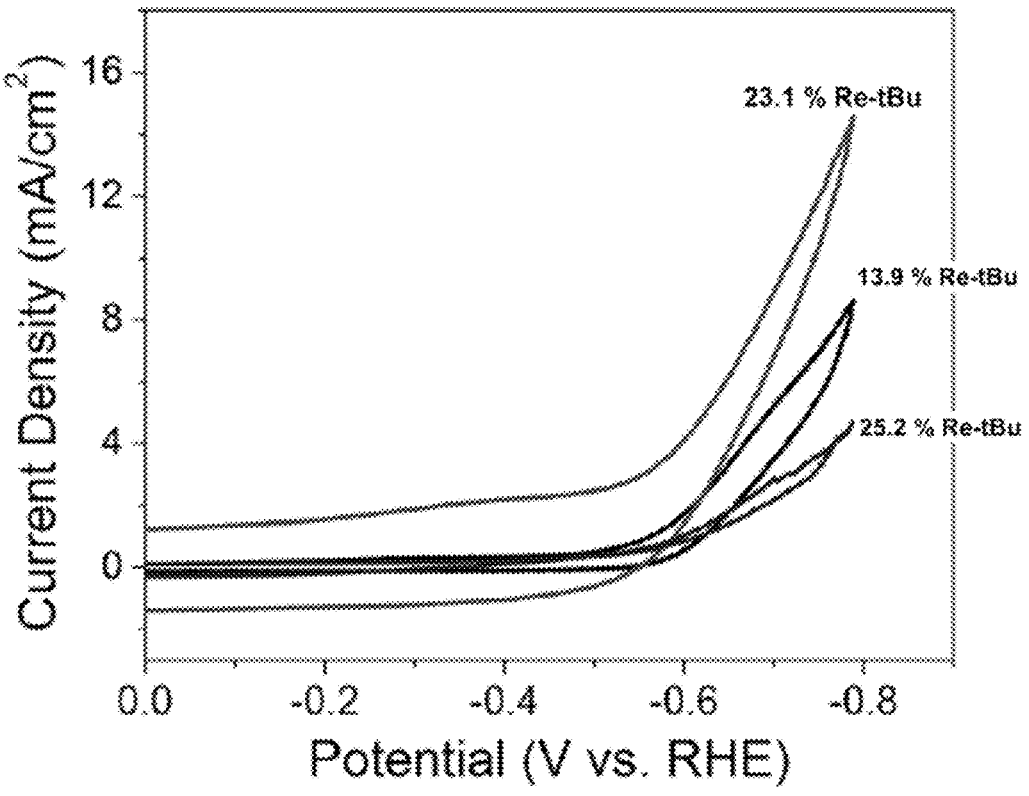
FIG. 20 depicts a CV of Re(tBu-bpy)/MWCNT in $CO_2$ saturated 0.1 M $KHCO_3$.

Previous studies showed that reactivity and selectivity of Re-bpy in organic solvents depends on the acid strength (pKa). The acidity of 0.1 M $KHCO_3$ solution saturated with $CO_2$ corresponds to pH=6.81, and pH=7.23 for 0.5 M $KHCO_3$. Chen C.; Zhang B.; Zhong Z.; Cheng Z., Selective Electrochemical $CO_2$ Reduction Over Highly Porous Gold Films. *J. Mater. Chem.* A 2017, 5, 21955-21964. However, for the Re(tBu-bpy)/MWCNT system a trade-off exists between acidity of the solution and mass transport of $CO_2$ to the active sites of the embedded catalyst. FIG. 20 depicts a CV of Re(tBu-bpy)/MWCNT in $CO_2$ saturated 0.1 M $KHCO_3$; electrodes 2, 3, 4 were used as working electrodes, Ag/AgCl was used as a reference, Pt was used as a counter electrode, and a scan rate of 100 mV/s was used. The uppermost curve at a potential of −0.7 is 23.1% Re-Bu, the middle curve at a potential of −0.7 is 13.9% Re-tBu, and the lowest curve at a potential of −0.7 is 25.2% Re-tBu. Thus, electrodes operated at −0.56 V vs. RHE in 0.1 M $KHCO_3$ performed poorly in comparison to 0.5 M $KHCO_3$ solution.

Figure 21:
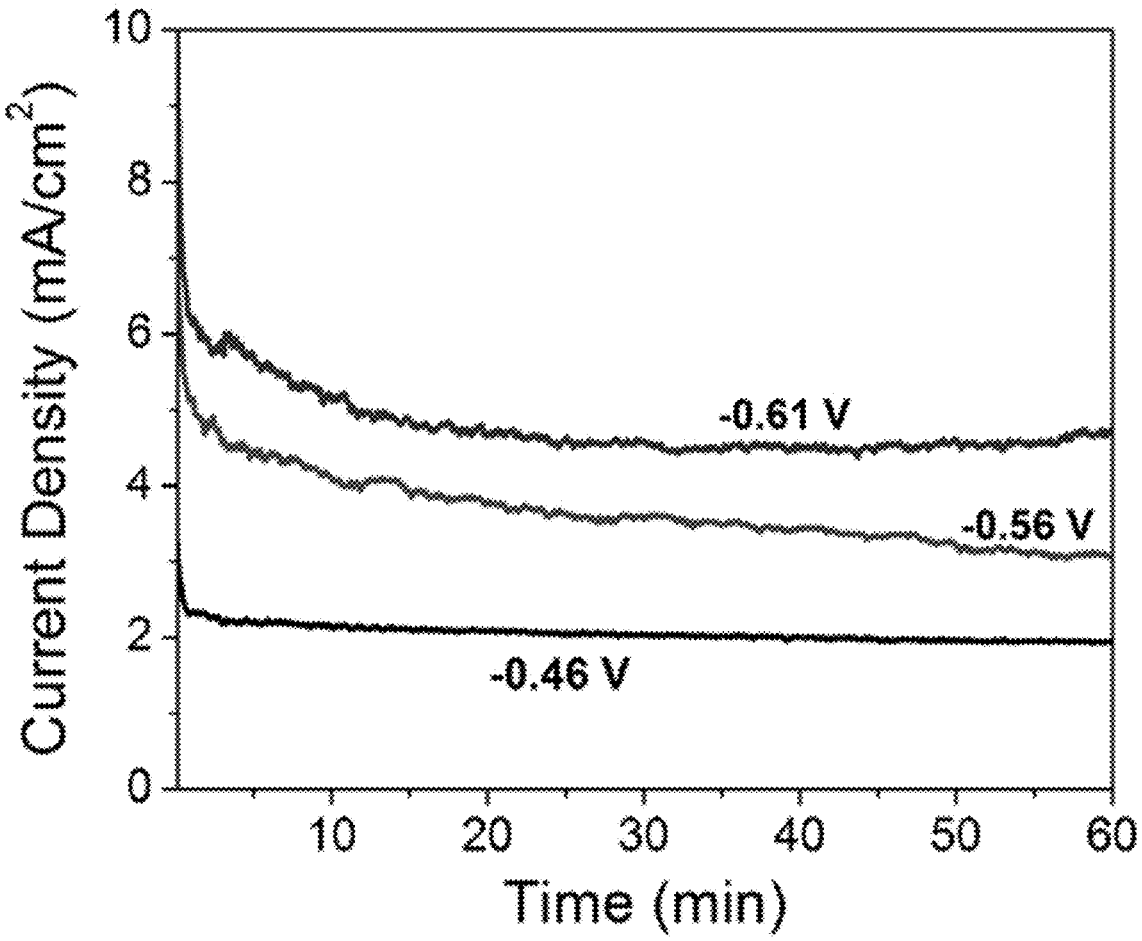
FIG. 21 depicts a CPE of electrode 4 at −0.46, −0.56, −0.61 V vs. RHE in $CO_2$ saturated 0.5 M $KHCO_3$.

FIG. 21 depicts a CPE of electrode 4 at −0.46 V (bottom plot), −0.56 V (middle plot), and −0.61 V (top plot) vs. RHE in $CO_2$ saturated 0.5 M $KHCO_3$. The selectivity of the Re(tBu-bpy)/MWCNT is related to the applied potential. At −0.62 V vs. RHE the system produces CO with Faradaic efficiency of 97% vs. 3% for $H_2$, but at −0.67 V vs. RHE, Faradaic efficiency decreased to 84% for CO and 15% for $H_2$. Thus the Re(tBu-bpy)$(CO)_3$Cl/MWCNT electrodes display overpotentials for CO and $H_2$ evolution that favor CO evolution at less negative potentials than $H_2$ evolution, the reverse of normal thermodynamic expectations for these reactions.

The comparison of the Re(tBu-bpy)/MWCNT catalyst to the best hybrid catalysts based on molecular catalysts on solid carbon supports are summarized in Table 9. Re(tBu-bpy)/MWCNT has a lower operating potential and highest Faradaic efficiency for CO in comparison to other catalysts.

TABLE 9

Comparison of existing molecular electrocatalysts on various carbon supports.

| Catalyst | Ecat. (V vs. RHE) | Current Density ($mA/cm^2$) | Charge (C) | TOF ($s^{-1}$) | FE (CO) |
|---|---|---|---|---|---|
| Re(tBu-bpy) | −0.56 | 4.0 | 14.4 | 1.6 | 99 |
| Mn-pyrrolyl | −0.39 | 2.4 | 8.6 | 0.009 | 87 |
| CoPc-CN | −0.63 | 15 | 54 | 4.1 | 98 |
| CoPc-P4VP | −0.75 | 2.0 | 7.2 | 4.8 | 90 |
| COF-367-Co | −0.67 | 2.9 | 10.4 | 2.6 | 90 |

Figure 10:
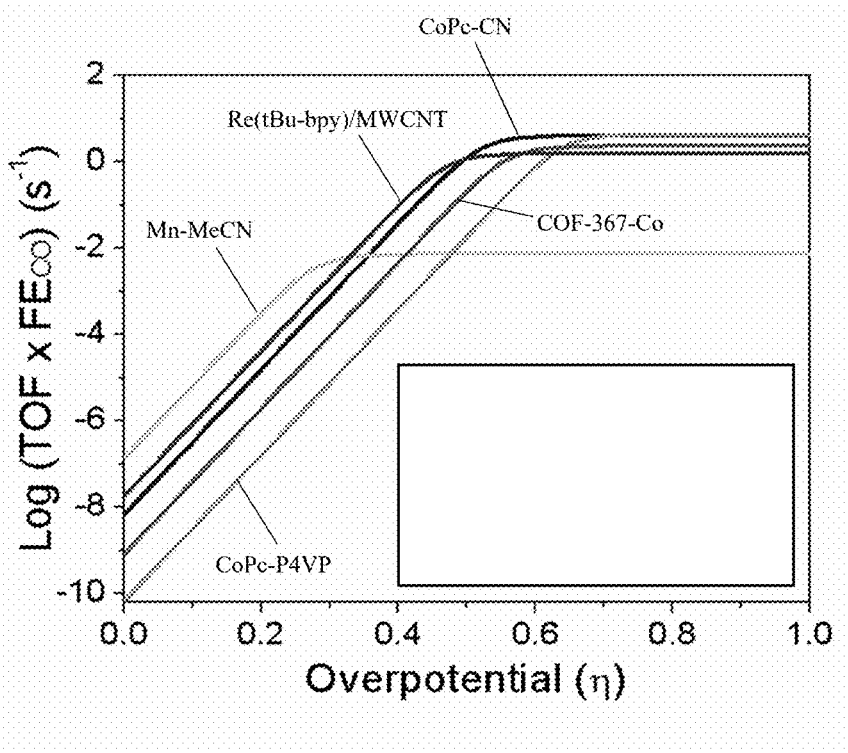
FIG. 10 depicts catalytic Tafel plots for Re(tBu-bpy)/MWCNT, CoPc-CN, CoPc-P4VP, COF-367-Co, and Mn-MeCN.

Catalytic Tafel plots were created to benchmark the catalytic system with the existing molecular catalysts and they represent the relationship between thermodynamic and kinetic parameters: η and TOF. Tafel plots were calculated based on log TOF multiplied by FE(CO) and plotted against the corresponding overpotentials. FIG. 10 depicts catalytic Tafel plots for Re(tBu-bpy)/MWCNT (electrode 4; second line from top at η=0.0), CoPc-CN (cobalt-2,3,7,8,12,13,17,18-octacyano-phthalocyanine; third line from top at η=0.0), CoPc-P4VP (cobalt phthalocyanine poly-4-vinylpyridine at glassy carbon electrode at pH 4; lowest line at η=0.0), COF-367-Co (cobalt porphyrin in piphenyl-4,4'-dicarboxaldehyde covalent organic framework on carbon fabric; fourth line from top at η=0.0), and Mn-MeCN (Mn(4,4'-di(1H-pyrrolyl-3-propyl carbonate)-2,2'-bipyridine)(CO)3MeCN]$^+$ $(PF6)^-$; uppermost line at η=0.0). The Tafel plot for this catalyst was calculated based on the reported TON and bulk concentration of the catalyst, under the assumption that TON and TOF should be higher if calculated per electroactive species. Re(tBu-bpy)/MWCNT displayed the best optimal characteristics of η and TOF in comparison to the other catalysts with overpotential of 0.45 and log TOF×FE (CO)=0.2.

Example 9. Gas Adsorption

Materials were characterized by $N_2$ physisorption at 77 K using a Micromeritics ASAP 2020 after a 12 h activation under vacuum at 423 K. Brunauer-Emmet-Teller (BET) surface areas were calculated following established consistency criterion. Increasing loading of the rhenium complex results in surface area loss in excess of the added non-porous mass (Table 10), indicating surface adsorption.

TABLE 10

Results of gas adsorption measurements.

| Sample | BET Surface Area ($m^2/g$) |
|---|---|
| Blank | 175 ± 0.6 |
| 1.4% Re | 120 ± 0.4 |
| 12.5% Re | 107 ± 0.9 |
| 22.2% | 87 ± 0.9 |
| 23.4% | 83 ± 0.8 |

Figure 22A:
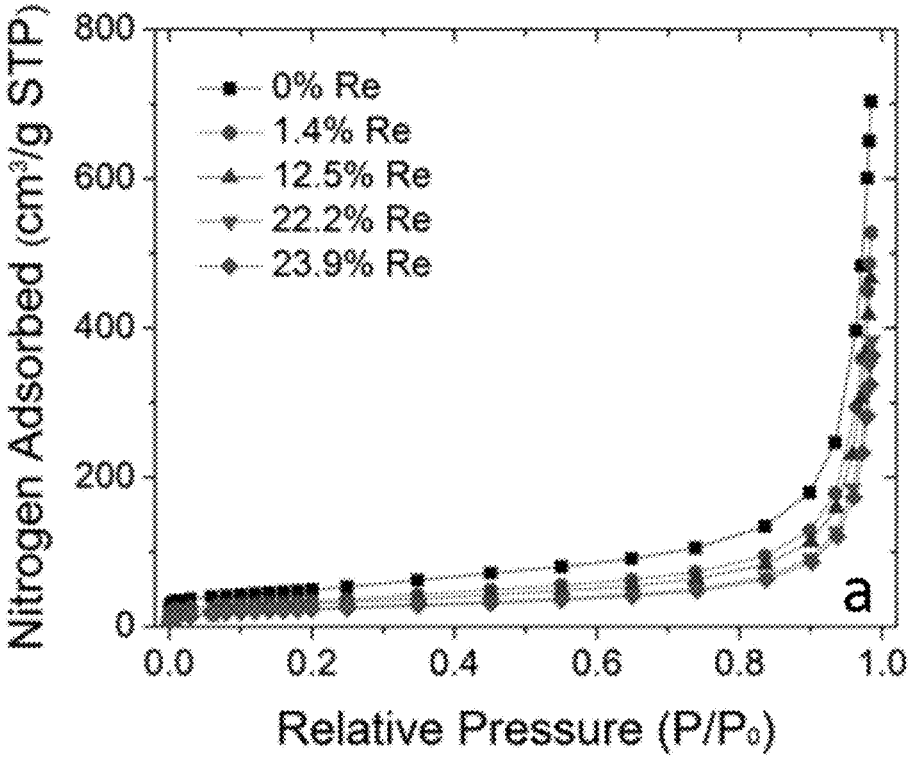
FIG. 22A depicts an $N_2$ adsorption of a Re-loaded MWCNT/CNF composite in linear scale.
Figure 22B:
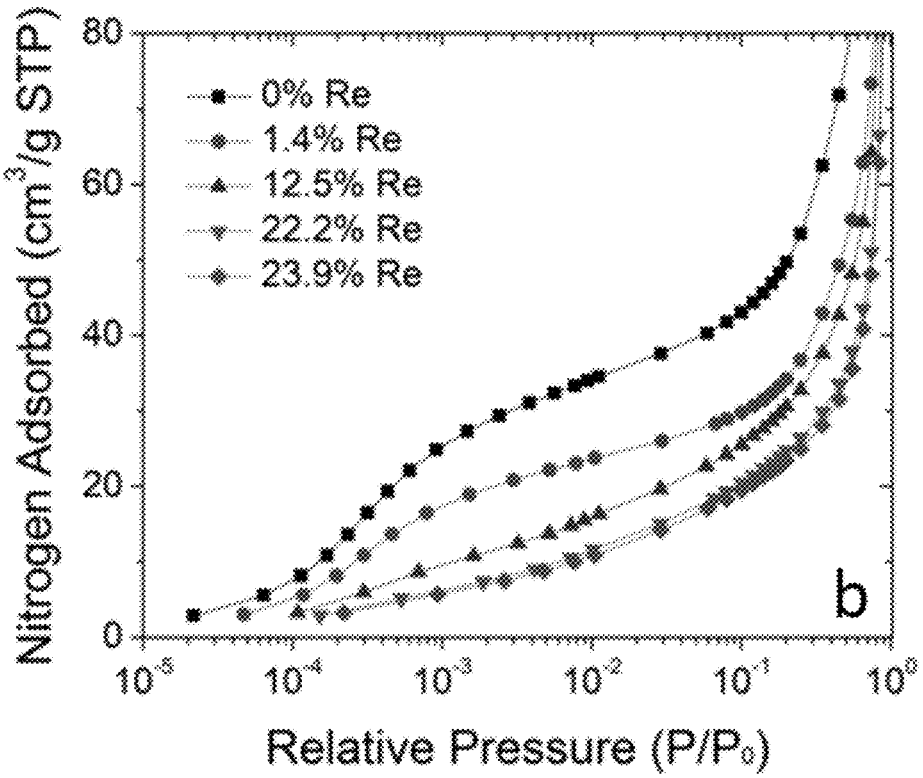
FIG. 22B depicts an $N_2$ adsorption of a Re-loaded MWCNT/CNF composite in log scale.
Figure 22C:
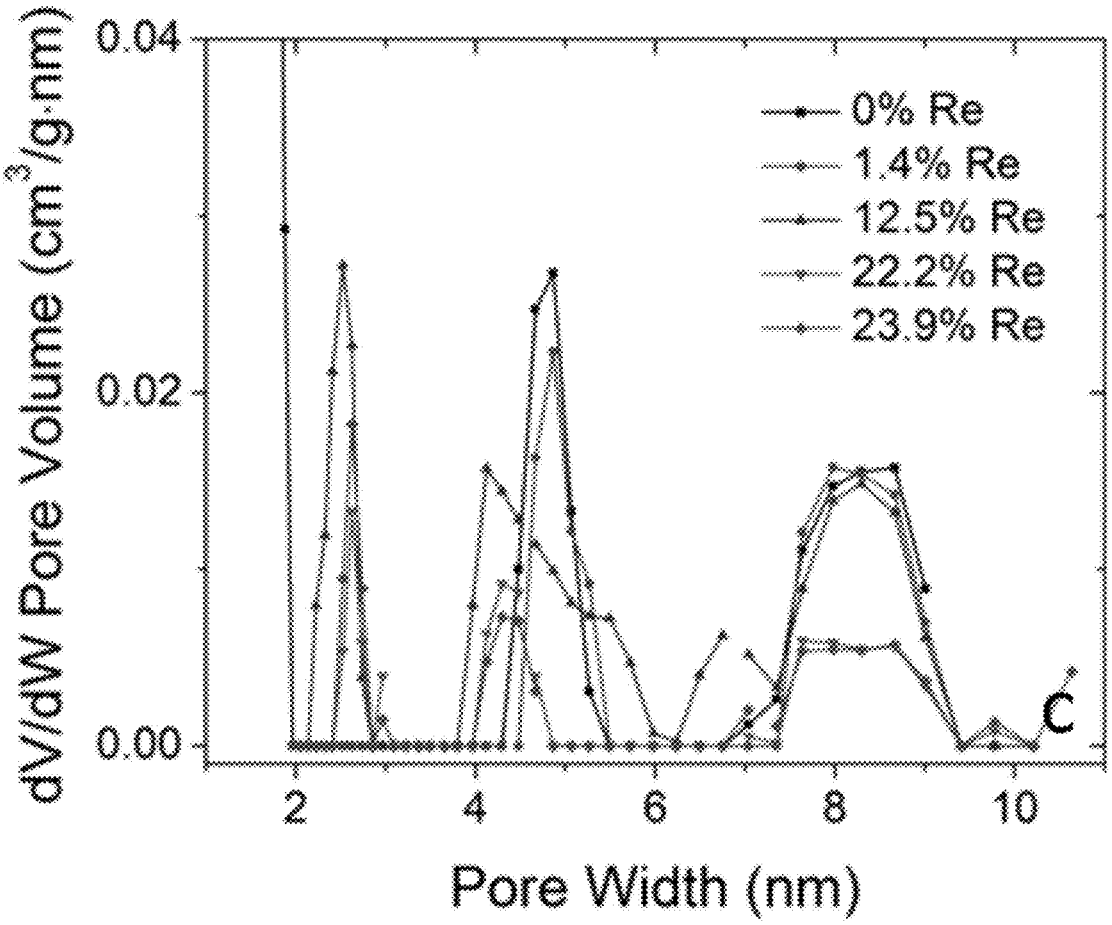
FIG. 22C depicts density functional theory (DFT) pore size distributions of samples calculated from $N_2$ isotherms.

FIG. 22A depicts an $N_2$ adsorption (77 K) of a Re-loaded MWCNT/CNF composite in linear scale; 0% Re (square data points, no corners on plot), 1.4% Re (circular data points), 12.5% Re (triangular data points, apex of triangles pointing up), 22.2% Re (triangular data points, apex of triangles pointing down), 23.9% Re (square data points, 2 corners on plot). FIG. 22B depicts an $N_2$ adsorption (77 K) of a Re-loaded MWCNT/CNF composite in log scale; 0% Re (square data points, no corners on plot), 1.4% Re (circular data points), 12.5% Re (triangular data points, apex of triangles pointing up), 22.2% Re (triangular data points, apex of triangles pointing down), 23.9% Re (square data points, 2 corners on plot). FIG. 22C depicts density functional theory (DFT) pore size distributions of samples calculated from $N_2$ isotherms (77 K); 0% Re (square data points, no corners on plot), 1.4% Re (circular data points), 12.5% Re (triangular data points, apex of triangles pointing up), 22.2% Re (triangular data points, apex of triangles pointing down), 23.9% Re (square data points, 2 corners on plot). Sample pore size distributions (PSD) were calculated using the Microactive software package (Micromeritics) as multiwalled nanotubes under the DFT Pore Size model. The PSD of the blank sample shows a bimodal pore size distribution up to 10 nm—pore volume beyond this point is poorly defined and likely a result of interparticle condensation rather than intrinsic material porosity—which is closely mimicked by samples with low (1.4%) rhenium loading. Intermediate rhenium loadings (12.5%) result in noticeable changes in the PSD, where new pore distributions appear near 2.5 nm and 7 nm, likely from the disruption of the larger parent distributions. Moreover, the previously well-defined distribution at 5 nm is noticeably broadened. Further increasing (>20%) rhenium content continues to disrupt the pristine PSD, with a pronounced loss of cumulative porosity throughout the distribution. The changes in PSD in conjunction with the decreases in BET surface area suggest that the rhenium complex is located within the pores of the substrate, though it is not possible to rule out the presence of external complex adsorption.

A number of embodiments of the invention have been described. Nevertheless, it will be understood that various modifications may be made without departing from the spirit and scope of the invention. Accordingly, other embodiments are within the scope of the following claims.

What is claimed is:

1. A composition comprising a rhenium catalyst and a carbon support wherein:

the rhenium catalyst has a formula of Re(4,4'-R-2,2'-bipyridine)$(CO)_3X$;

R is an electron donating group or an electron withdrawing group;

X is a halogen, acetonitrile, $CH_3CN(OTf)$, or Py(OTf); and wherein the rhenium catalyst is dispersed on a surface of the carbon support, wherein the carbon support is multi-walled carbon nanotubes.

2. The composition of claim 1, wherein X is a halogen.

3. The composition of claim 1, wherein X is chloro.

4. The composition of claim 1, wherein R is an electron donating group.

5. The composition of claim 1, wherein the rhenium catalyst is Re(tBu-bpy)$(CO)_3Cl$.

6. The composition of claim 1, wherein R is an electron withdrawing group.

7. The composition of claim 1, wherein the composition is characterized by a current density of at least about 4 $mA/cm^2$.

8. The composition of claim 1, wherein the composition is characterized by a current density of about 4 $mA/cm^2$.

9. The composition of claim 1, wherein the composition is characterized by a turnover number (TON) greater than about 5600 and a turnover frequency (TOF) greater than about 1.6 $s^{-1}$.

10. A method for electrocatalytically reducing $CO_2$ to CO, comprising:

contacting an electrode with $CO_2$;

wherein the electrode is in an aqueous solution having a pH of at least 4, comprising an electrolyte;

wherein the electrode comprises the composition of claim 1; and wherein the method is performed at a temperature of at least about 5 °C.

11. The method of claim 10, wherein the selectivity for CO over $H_2$ is at least about 99%.

12. The method of claim 10, wherein the selectivity for CO over $H_2$ is from about 30% to about 100%.

13. The method of claim 10, wherein the method is characterized by a Faradaic efficiency of at least about 99%.

14. The method of claim 10, wherein the electrolyte comprises $KHCO_3$.

15. The method of claim 10, wherein the method is performed at a temperature of from about 5 °C to about 35 °C.

16. The method of claim 10, wherein the pH of the aqueous solution is from about 6 to about 8.

17. A process for preparing an electrode, comprising:

suspending a rhenium catalyst, a carbon support, and carbon nanofiber in ethanol to form a suspension;

sonicating the suspension;

drop-casting the suspension onto a glassy carbon plate to form a drop-casted glassy carbon plate;

drying the drop-casted glassy carbon plate at a temperature from about 100 °C to about 180 °C for about 0.5 to about 24 hours; and wherein the rhenium catalyst is the rhenium catalyst according to claim 1.

18. The process of claim 17, wherein the suspension is drop-casted at a temperature from about 40 °C to about 80 °C.

19. The process of claim 17, wherein the drop-casted glassy carbon plate is dried at a temperature of about 150 °C for about 1 hour.

* * * * *